US009763498B2

(12) United States Patent
Kojima et al.

(10) Patent No.: US 9,763,498 B2
(45) Date of Patent: Sep. 19, 2017

(54) SLIDER COVER FOR SLIDE FASTENER AND SLIDE FASTENER WITH SLIDE COVER

(75) Inventors: Masayoshi Kojima, Toyama (JP); Wataru Izumi, Toyama (JP); Takanori Fujisawa, Toyama (JP)

(73) Assignee: YKK Corporation (JP)

( * ) Notice: Subject to any disclaimer, the term of this patent is extended or adjusted under 35 U.S.C. 154(b) by 350 days.

(21) Appl. No.: 14/424,492

(22) PCT Filed: Aug. 31, 2012

(86) PCT No.: PCT/JP2012/072230

§ 371 (c)(1),
(2), (4) Date: Feb. 27, 2015

(87) PCT Pub. No.: WO2014/033926

PCT Pub. Date: Mar. 6, 2014

(65) Prior Publication Data

US 2015/0237973 A1 Aug. 27, 2015

(51) Int. Cl.
*A44B 19/26* (2006.01)

(52) U.S. Cl.
CPC ..... *A44B 19/26* (2013.01); *A44B 19/262* (2013.01); *A44B 19/265* (2013.01); *Y10T 24/2586* (2015.01); *Y10T 24/2588* (2015.01)

(58) Field of Classification Search
CPC ..... A44B 19/265; A44B 19/262; A44B 19/26; A44B 19/42; Y10T 24/258; Y10T 24/2589; Y10T 24/2561; Y10T 29/49783; Y10T 24/2586; Y10T 24/2588
USPC ..... 24/426
See application file for complete search history.

(56) References Cited

U.S. PATENT DOCUMENTS

| | | | | |
|---|---|---|---|---|
| 2,838,969 | A * | 6/1958 | Simmons, Sr. | B21D 53/54 227/39 |
| 2,855,652 | A | 10/1958 | Jones | |
| 2,933,792 | A | 4/1960 | Malmborg | |
| 4,819,308 | A | 4/1989 | Baroky | |
| 5,007,144 | A | 4/1991 | Terada et al. | |
| 6,701,584 | B2 | 3/2004 | Metzger | |
| 9,456,663 | B1 * | 10/2016 | Wheeler | A44B 19/301 |

(Continued)

FOREIGN PATENT DOCUMENTS

| | | |
|---|---|---|
| GB | 810334 A | 3/1959 |
| GB | 2386641 A | 9/2003 |
| JP | S57-194309 A | 6/1956 |

(Continued)

OTHER PUBLICATIONS

International Preliminary Report on Patentability, PCT Application No. PCT/JP2012/072230, dated Mar. 3, 2015.

(Continued)

*Primary Examiner* — Jack W Lavinder
(74) *Attorney, Agent, or Firm* — Kilpatrick Townsend & Stockton LLP

(57) ABSTRACT

There is provided a slider cover for a slide fastener. An upper member and a lower member are spaced apart from each other in an upward and downward direction and arranged in parallel to each other. A connecting post connects the upper member with the lower member. The upper member includes a receiving portion configured to receive at least a part of an upper blade of a slider.

18 Claims, 24 Drawing Sheets

(56) References Cited

U.S. PATENT DOCUMENTS

2014/0082895 A1* 3/2014 Gold ..... A44B 19/26
24/415

FOREIGN PATENT DOCUMENTS

| | | | |
|---|---|---|---|
| JP | 2002-191414 | A | 7/2002 |
| JP | 2004-24740 | A | 1/2004 |
| JP | 2005-160785 | A | 6/2005 |
| JP | 2006-223519 | A | 8/2006 |

OTHER PUBLICATIONS

Office Action, Japanese Patent Application No. 2014-532692, dated Mar. 29, 2016.
International Search Report, PCT Application No. PCT/JP2012/072230, dated Nov. 13, 2012.
Written Opinion, PCT Application No. PCT/JP2012/072230, dated Nov. 13, 2012.
Supplementary European Search Report, European Patent Application No. 12883804.2, dated Apr. 8, 2016.

* cited by examiner

SLIDER COVER FOR SLIDE FASTENER AND SLIDE FASTENER WITH SLIDE COVER

This application is a national stage application of PCT/JP2012/072230, which is incorporated herein by reference.

TECHNICAL FIELD

The present invention relates to a slider cover for a slide fastener and a slide fastener with the slider cover.

BACKGROUND ART

General slide fasteners are configured to engage or disengage fastener element rows of a fastener stringer with or from each other by sliding a slider and thus used as an opening and closing member for an opening of bags or the like.

Conventionally, a slider to which a function other than the opening and closing function is additionally imparted by partially changing a shape of sliders which has been typically used has been disclosed. For example, a slider in which shoulder mouth-sides of an upper blade and a lower blade of the slider are provided with side plates integrally extending therefrom to prevent jamming of a fabric is known (e.g., see Patent Document 1).

Also, conventionally, a zipper guard which includes a support member attached to a guide post of a slider and a guard member attached to the support member to prevent a fabric on the periphery of the slider from being jammed into the slider is known (e.g., see Patent Document 2).

Further, conventionally, one in which an insertion mouth side of a lower blade of a body of a slider is extended and a sign board protruding higher than an upper blade assists guiding of an insert pin is known (e.g., see Patent Document 3).

In addition, conventionally, one in which an engaging portion is provided on a part of a body of a slider made of metal and a resin cover is attached to a lower surface of a lower blade of the body to prevent the lower blade from giving a cool feeling to a user is known (e.g., see Patent Document 4).

PRIOR ART DOCUMENT

Patent Document

Patent Document 1: Japanese Patent Application Publication No. 2005-160785 A

Patent Document 2: U.S. Pat. No. 4,819,308 Specification

Patent Document 3: Japanese Utility Model Application Publication S57-194309 A

Patent Document 4: U.S. Pat. No. 5,007,144 Specification

SUMMARY OF INVENTION

Problems to Be Solved by Invention

However, in the sliders described in Patent Documents 1 and 3, the side plate or the sign plate having an additional function is integrally formed with the body of the sliders, thereby providing a lower versatility. Also, in the slider having the zipper guard or the slider having the cooling feeling prevention function as described in Patent Documents 2 and 4, the engaging portion has to be previously processed to allow the support member to be additionally attached to the guide post or the resin cover to be additionally attached to the part of the body of the slider, thereby providing a lower versatility.

The present invention has been made keeping in mind the above problems, and an object thereof is to provide a slider cover for a slide fastener, in which the slider cover can be simply attached to a slider without performing a processing to the slider and additional functions can be imparted to the slider, and a slide fastener with the slider cover.

Means for Solving Problems

The object of the present invention is achieved by the following configurations.

(1) A slider cover for a slide fastener, including: an upper member and a lower member which are spaced apart from each other in an upward and downward direction and arranged in parallel to each other; and a connecting post connecting the upper member with the lower member, wherein the upper member includes a receiving portion configured to receive at least a part of an upper blade of a slider.

(2) The slider cover for the slide fastener according to (1), wherein the receiving portion is configured to receive an entire circumference of the upper blade.

(3) The slider cover for the slide fastener according to (1) or (2), wherein the receiving portion is a hole portion penetrating through upper and lower surfaces of the upper member.

(4) The slider cover for the slide fastener according to (3), wherein the receiving portion has an inner surface for defining the hole portion; and wherein at least a part of the inner surface receives the upper blade so as to come in contact with at least a part of a side wall of the upper blade.

(5) The slider cover for the slide fastener according to (4), wherein the receiving portion is formed to be larger than the upper blade, and wherein in a state where the slider cover is attached to the slider, a gap is formed between the inner surface of the receiving portion and the side wall of the upper blade.

(6) The slider cover for the slide fastener according to any one of (1) to (5), wherein in a state where the slider cover is attached to the slider, an upper surface of the upper member and an upper surface of the upper blade are positioned at the same height.

(7) The slider cover for the slide fastener according to any one of (1) to (5), wherein the slider includes a pull tab attachment portion provided on an upper surface of the upper blade and a pull tab attached to the pull tab attachment portion, and wherein the pull tab attachment portion and the pull tab are arranged above the upper member.

(8) The slider cover for the slide fastener according to any one of (1) to (7), further including cover-side flanges formed along both right and left side edges of the upper member to protrude downward.

(9) The slider cover for the slide fastener according to (8), wherein lower end edges of the cover-side flanges are arranged below lower end edges of slider-side flanges which are formed along both right and left side edges of the upper blade to protrude downward.

(10) The slider cover for the slide fastener according to any one of (1) to (9), wherein a recess portion configured to receive at least a part of a lower blade of the slider is formed on the lower member.

(11) The slider cover for the slide fastener according to any one of (1) to (10), further including a pair of right and left element passages formed between the upper member and the lower member and on both sides of the connecting post and configured to guide fastener element rows of the slide fastener.

(12) The slider cover for the slide fastener according to (11), wherein at least one of the upper member and the lower member is formed with flanges respectively formed along both right and left side edges thereof and configured to guide the fastener element rows.

(13) The slider cover for the slide fastener according to (11) or (12), wherein a pair of right and left recessed grooves are formed in a lower surface of the lower member along the pair of right and left element passages.

(14) The slider cover for the slide fastener according to any one of (11) to (13), wherein an angle of an entrance edge portion of the element passages with respect to an axis line of the element passages is set to be 90°±20°.

(15) The slider cover for the slide fastener according to (10), wherein the lower member is comprised of a pair of right and left first lower plates extending from the connecting post outward in a width direction thereof and a second lower plate extending from the first lower plates and having an upper surface formed downward below upper surfaces of the first lower plates, and wherein a stepped portion which can come in contact with a side wall of the lower blade is formed between inner surfaces of the first lower plates and an inner surface of the second lower plate.

(16) The slider cover for the slide fastener according to (15), wherein at least one of the pair of right and left first lower plates extends forward beyond the upper member.

(17) The slider cover for the slide fastener according to (16), wherein inner surfaces of the first lower plates have an inclined surface inclined forward and downward from a rear end portion of the inner surface.

(18) The slider cover for the slide fastener according to any one of (1) to (9), wherein a recess portion configured to receive the lower blade of the slider from a shoulder mouth-side end portion thereof to a rear mouth-side end portion thereof is formed on the lower member.

(19) The slider cover for the slide fastener according to any one of (1) to (18), wherein the slider cover is formed by engaging a first member which is comprised of at least the upper member with a second member which is comprised of at least the lower member, and wherein the slider cover is connectable by an engaging protrusion portion which is formed on at least one of the first member and the second member and an engaging recess portion which is formed on at least the other of the first member and the second member.

(20) A slide fastener with a slider cover, including a pair of fastener tapes, a pair of fastener element rows respectively attached to opposing tape side edge portions of the pair of fastener tapes, a slider inserted onto the pair of fastener element rows, and the slider cover configured to be detachably attached to the slider in a state where the slider is inserted onto the pair of fastener element rows, wherein the slider includes: a body comprising an upper blade and a lower blade which are spaced apart from each other in an upward and downward direction and arranged in parallel to each other, a guide post connecting the upper blade with the lower blade at front end portions thereof, and a pull tab attachment portion provided on the upper blade; and a pull tab attached to the pull tab attachment portion, and wherein the slider cover is the slider cover according to any one of (1) to (19).

Advantageous Effects of Invention

According to the slider cover for the slide fastener of the present embodiment, the slider cover includes the upper member and the lower member, which are spaced apart from each other in the upward and downward direction and arranged in parallel to each other, and the connecting post connecting the upper member with the lower member, and the upper member has the receiving portion configured to receive at least a part of the upper blade of the slider. Accordingly, the slider cover can be simply attached to the slider without performing a processing to the slider and additional functions can be imparted to the slider.

EMBODIMENTS OF INVENTION

Hereinafter, each embodiment of a slider cover for a slide fastener according to the present invention will be described in detail with reference to the accompanying drawings. Meanwhile, in the following description, as for a slide fastener, a front side refers to a near side with respect to the paper surface of FIG. 1, a back side refers to a far side with respect to the paper surface of FIG. 1, an upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. As for a slider and a slider cover, an upper side refers to a near side with respect to the paper surface of FIG. 1, a lower side refers to a far side with respect to the paper surface of FIG. 1, a front side refers to an upper side with respect to the paper surface of FIG. 1, a rear side refers to a lower side with respect to the paper surface of FIG. 1, a right side refers to a right side with respect to the paper surface of FIG. 1, and a left side refers to a left side with respect to the paper surface of FIG. 1. Also, a right and left direction of the slide fastener, the slider and the slider cover is also referred to as a width direction.

First Embodiment

Firstly, a first embodiment of a slider cover for a slide fastener according to the present invention will be described with reference to FIGS. 1 to 12.

Figure 1:
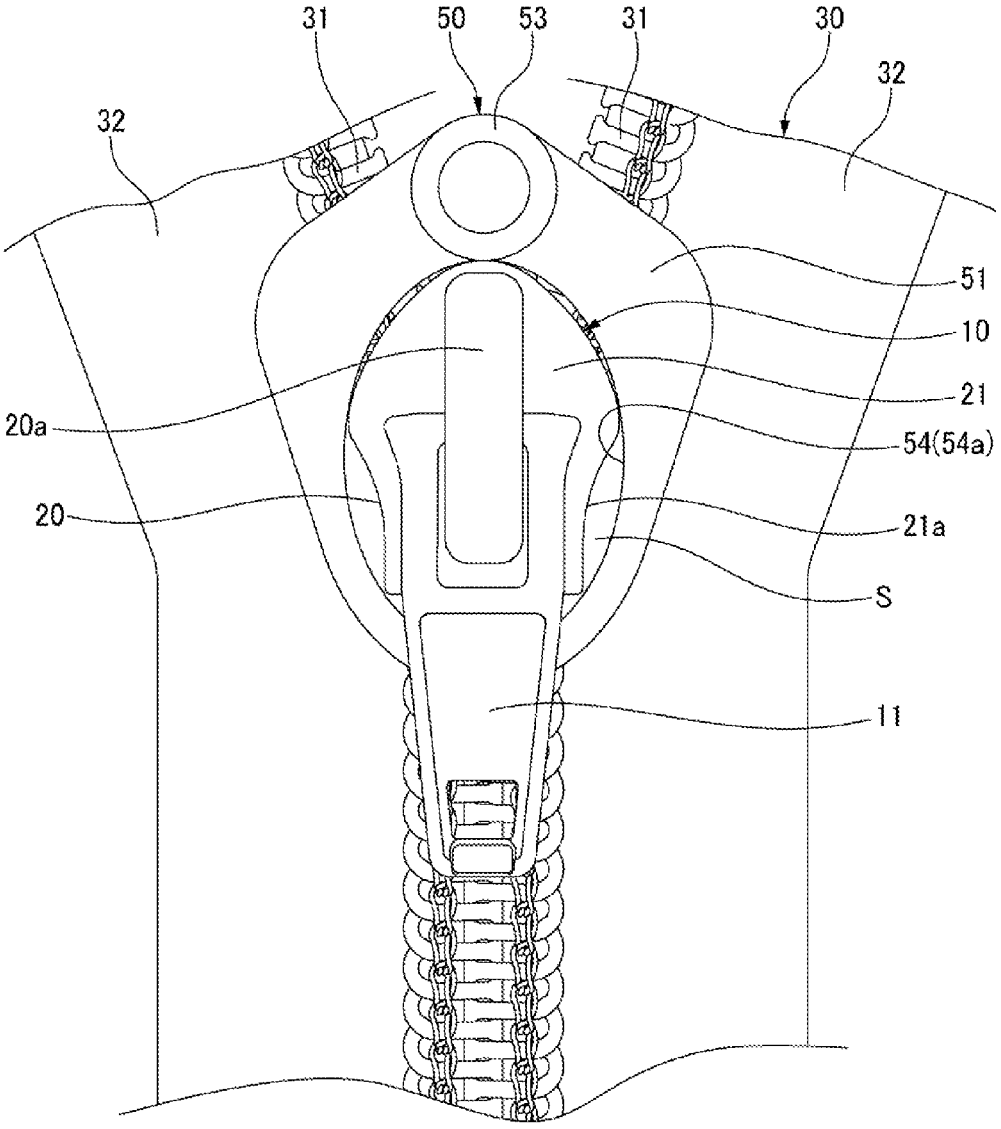
FIG. 1 is a front surface view of a slide fastener in a state where a first embodiment of a slider cover according to the present invention is attached to a slider.
Figure 2:
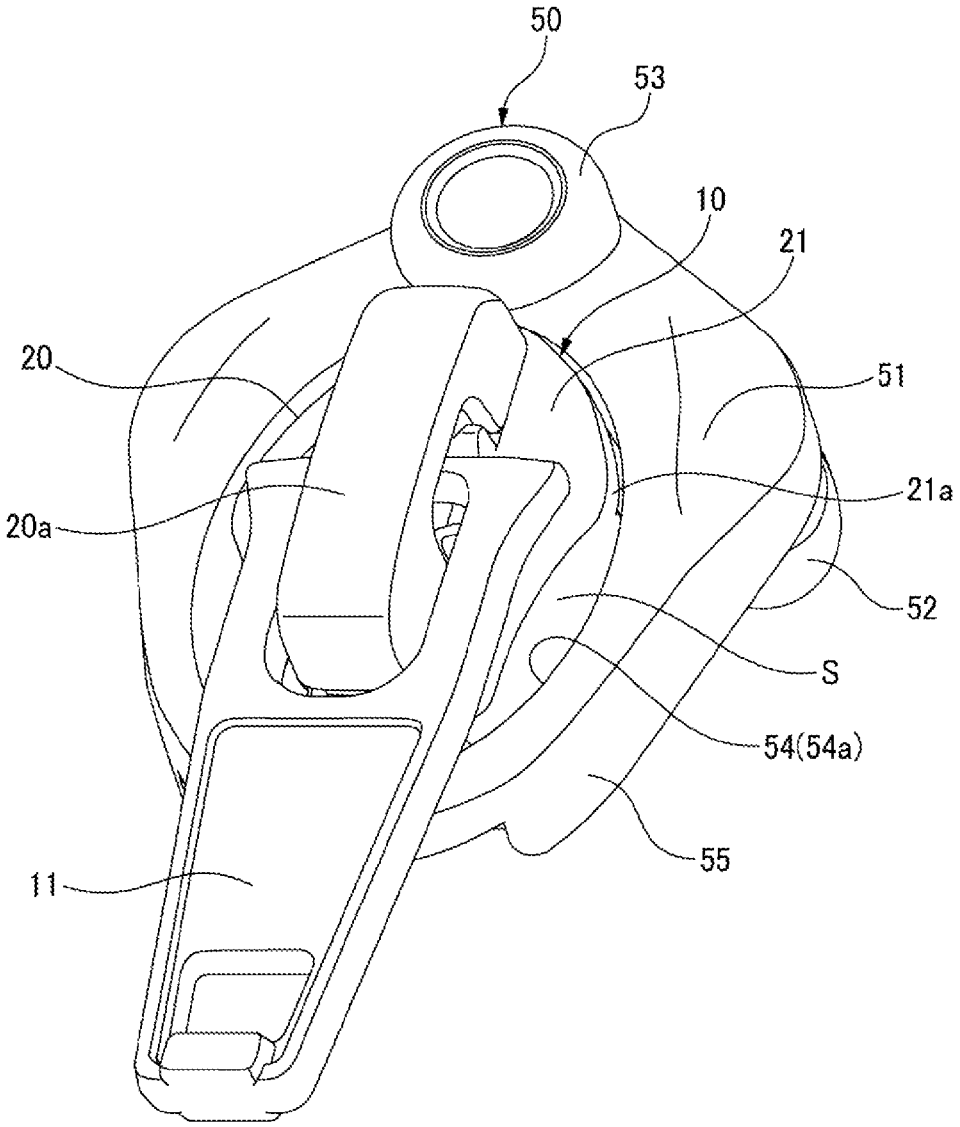
FIG. 2 is a perspective view of the slider and the slider cover shown in FIG. 1.
Figure 3:
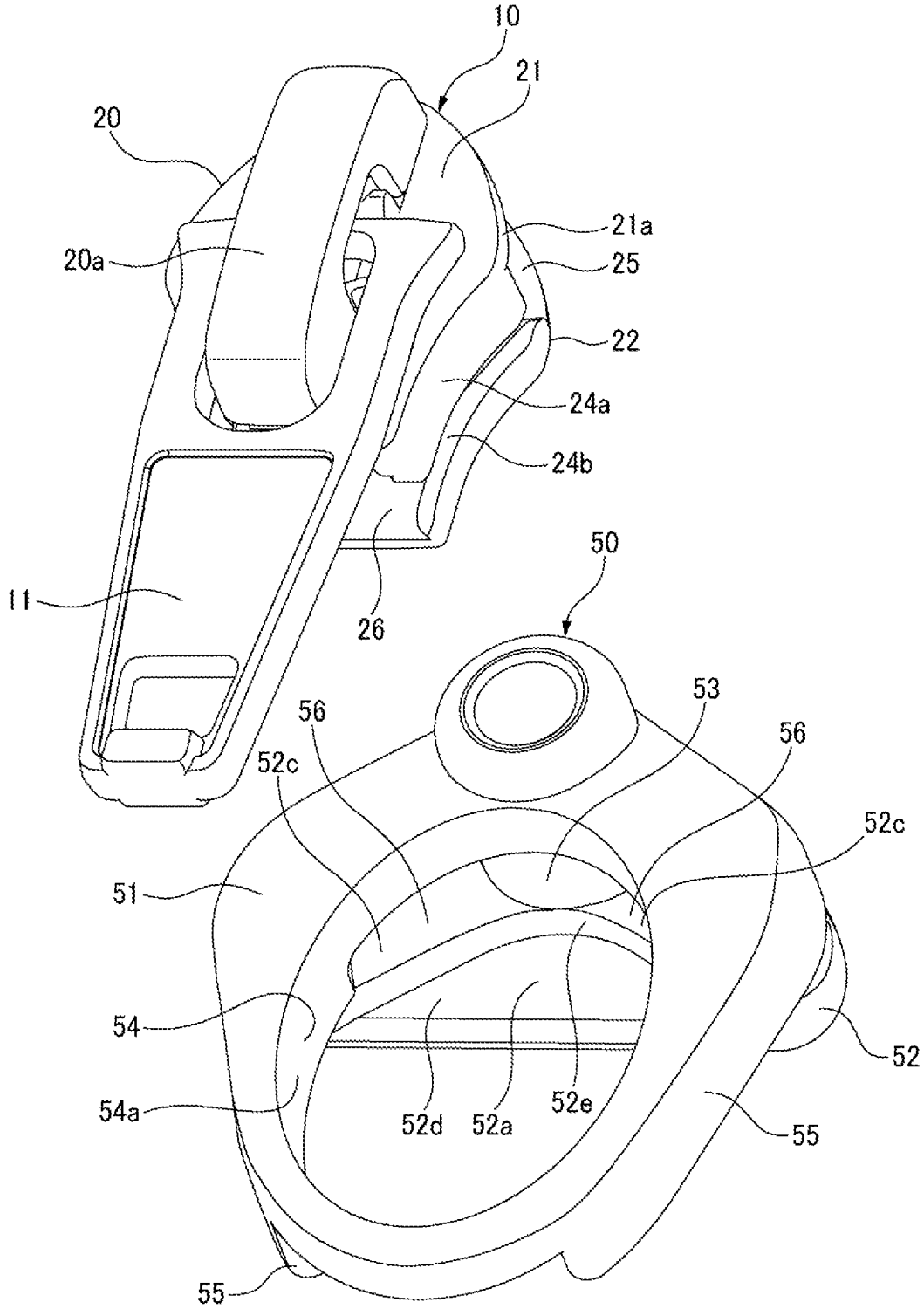
FIG. 3 is a perspective view of the slider cover separated from the slider.
Figure 4:
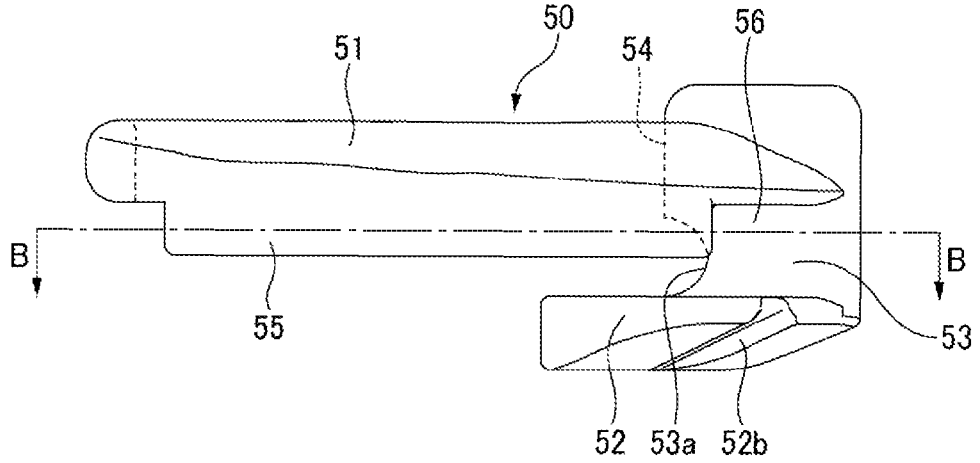
FIG. 4 is a right side view of the slider cover.

The slider cover 50 of the present embodiment is configured to be detachably attached to a slider 10 for a slide fastener shown in FIGS. 1 to 3. Preferably, the slider cover 50 is configured to be detachably attached to the slider 10, particularly in a state where the slider 10 is inserted onto fastener element rows.

The slider 10 is a slider having an automatic stop function and includes a body 20 and a pull tab 11, which is attached to a pull tab attachment portion 20*a* on an upper blade 21, as described below, of the body 20. Also, the slider 10 is formed of synthetic resin, metal or the like.

Figure 7:
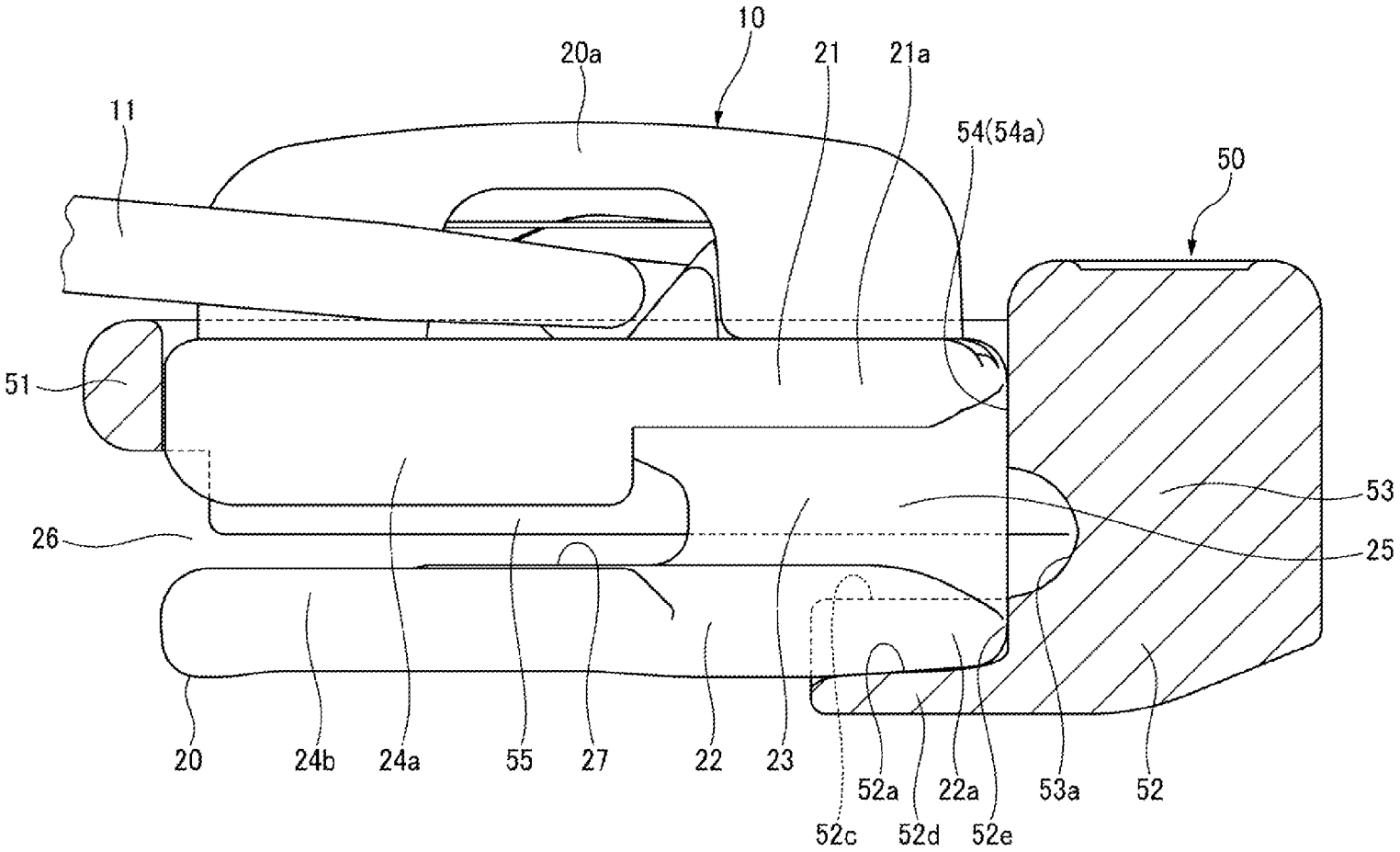
FIG. 7 is a sectional view of the slider cover attached to the slider, taken along a line A-A in FIG. 5.
Figure 8:
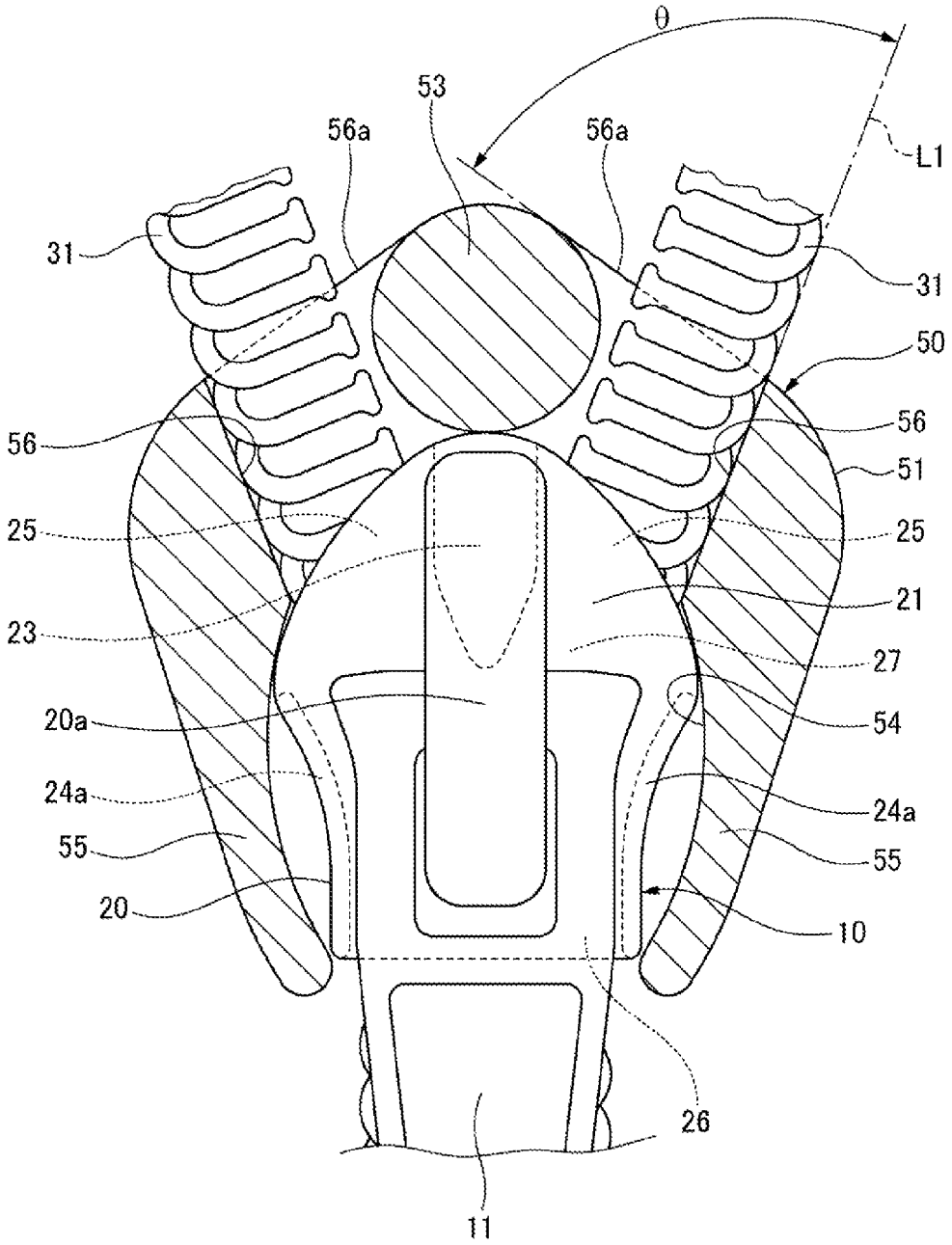
FIG. 8 is a sectional view of the slider cover attached to the slider, taken along a line B-B in FIG. 4.

As shown in FIGS. 3, 7 and 8, the body 20 includes the upper blade 21 and a lower blade 22, which are spaced apart from each other in an upward and downward direction and are arranged in parallel to each other, a guide post 23 connecting the upper blade 21 with the lower blade 22 at front end portions thereof, upper flanges (slider-side flanges) 24*a* formed along both right and left side edges of the upper blade 21 to protrude downward, and lower flanges 24*b* formed along both right and left side edges of the lower blade 22 to protrude upward. Therefore, on a front portion of the body 20, right and left shoulder mouths 25 which are separated from each other by the guide post 23 are formed, and on a rear portion of the body 20, a rear mouth 26 is formed. Also, a generally Y-shaped element guide path 27 configured to communicate the right and left shoulder mouths 25 with the rear mouth 26 is formed between the upper blade 21 and the lower blade 22, and the element guide path 27 forms a passage through which fastener element rows 31 of the slide fastener 30 are inserted.

The slide fastener 30 includes a pair of right and left fastener tapes 32, a pair of right and left coil-shaped fastener element rows 31 respectively attached to opposing tape side edge portions of the pair of right and left fastener tapes 32, and the slider 10 inserted onto the pair of right and left fastener element rows 31, and is configured to allow the pair of right and left fastener element rows 31 to be engaged to and disengaged from each other by sliding the slider 10. Alternatively, instead of the coil-shaped fastener element rows as described above, the fastener element rows may be, for example, a type in which synthetic resin or metal is directly injected on tape side edge portions of fastener tapes, or a type in which metal elements are crimped and fixed on tape side edge portions of fastener tapes.

As shown in FIGS. 3 to 8, the slider cover 50 includes a upper plate (upper member) 51 and a lower plate (lower member) 52, which are spaced apart from each other in the upward and downward direction and arranged in parallel to each other, and a connecting post 53 connecting the upper plate 51 with the lower plate 52. In addition, the upper plate 51 has a receiving portion 54 configured to receive the upper blade 21 of the slider 10. Also, the upper plate 51, the lower plate 52 and the connecting post 53 are integrally shaped. Further, the slider cover 50 is formed of elastomer or synthetic resin. Further, the connecting post 53 is formed in a circular cross-sectional shape.

The upper plate 51 has a upper surface and a lower surface, and the receiving portion 54 is a hole portion penetrating through the upper and lower surfaces of the upper plate 51 and having an elliptical shape as viewed from the upper side and is formed to receive the entire circumference of the upper blade 21. Also, the receiving portion 54 has an inner surface 54*a* for defining the hole portion, and a part of the inner surface 54*a* receives the upper blade 21 so as to come in contact with a part of a side wall 21*a* of the upper blade 21. Therefore, as shown in FIG. 2, the side wall 21*a* of the upper blade 21 is surrounded by the inner surface 54*a* of the receiving portion 54 and thus the slider cover 50 is held on the slider 10.

Also, in a state where the slider cover 50 is held on the slider 10, the upper surface of the upper plate 51 and an upper surface of the upper blade 21 are positioned at approximately the same height. Therefore, the pull tab attachment portion 20*a* provided on the upper surface of the upper blade 21 and the pull tab 11 attached to the pull tab attachment portion 20*a* are arranged above the upper plate 51 and thus the pull tab 11 can be operated above the upper plate 51. Accordingly, when sliding the slider 10, the inner surface 54*a* of the receiving portion 54 of the slider cover 50 comes in contact with the side wall 21*a* of the upper blade 21 only by operating the pull tab 11, and thus the slider cover 50 can be moved to correspond to movement of the slider 10.

In addition, the receiving portion 54 is formed to be larger than the upper blade 21, and as shown in FIG. 1, a gap S is formed between the inner surface 54*a* of the receiving portion 54 and the side wall 21*a* of the upper blade 21 in a state where the slider cover 50 is attached to the slider 10. Also, the gap S is particularly formed to be larger in a width direction of the slider 10 so that the slider 10 can be easily received in the receiving portion 54 of the slider cover 50.

Also, the slider cover 50 has cover-side flanges 55 formed along both right and left side edges of the upper plate 51 to protrude downward. More specifically, the cover-side flanges 55 are provided on both sides of the receiving portion 54 in a width direction thereof and extend from the lower surface of the upper plate 51 toward the lower plate 52. Also, inner surfaces of the cover-side flanges 55 are the same surface as the inner surface 54*a* of the receiving portion 54, and the cover-side flanges 55 are formed to extend from a front end to a rear end of the upper plate 51.

In addition, as shown in FIG. 7, in the state where the slider cover 50 is held on the slider 10, lower end edges of the cover-side flanges 55 are arranged below lower end edges of the upper flanges 24*a* of the slider 10.

Further, the slider cover 50 has a pair of right and left element passages 56 formed between the upper plate 51 and the lower plate 52 and also on both sides of the connecting post 53 and configured to guide the fastener element rows 31 of the slide fastener 30. More specifically, the element passages 56 are sections defined by the lower surface of the upper plate 51, an upper surface of the lower plate 52, right and left cover-side flanges 55 and side surfaces of the connecting post 53. Also, the element passages 56 are formed to be continued to the element guide path 27 of the slider 10 in the state where the slider cover 50 is held on the slider 10.

In addition, as shown in FIG. 8, an angle θ of an entrance edge portion 56*a* of the element passages 56 with respect to an axis line L1 of the element passages 56 is set to be 90°±20°. Herein, the axis line L1 is defined as an extension line extending along a direction in which an inner surface of the cover-side flanges 55 extends. Also, by setting the angle θ to 90°±20°, jamming of a fabric can be reduced. Meanwhile, if the angle θ is set to be smaller than 70°, the fabric is likely to be guided into the element passages 56 and thus the fabric is likely to be jammed into the slider 10 or the slider cover 50. In contrast, if the angle θ is set to be larger than 110°, sliding ability of the slider is poor. Also, although in FIG. 8, the axis line L1 is based on the right element passage 56, an axis line based on the left element passage 56 is bilateral-symmetry to the axis line L1.

Further, as shown in FIG. 7, a recess portion 53*a* is formed on a rear end side of the connecting post 53 to reduce a thickness of the connecting post 53 in a front and rear direction thereof, and the recess portion 53*a* is formed between the upper plate 51 and the lower plate 52. In addition, when the slider cover 50 is attached to the slider 10, as shown in FIG. 9, a gap between the upper plate 51 and the lower plate 52 can be easily widened due to the recess portion 53*a*.

Figure 5:
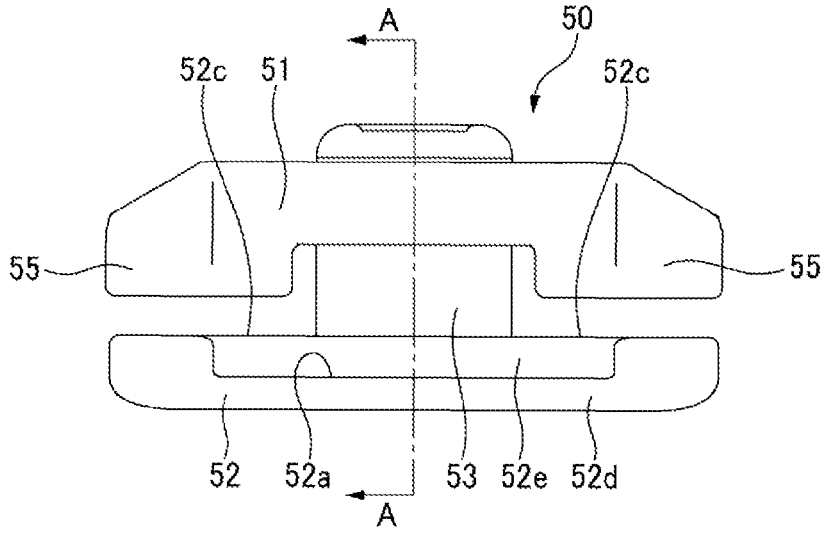
FIG. 5 is a rear view of the slider cover.
Figure 6:
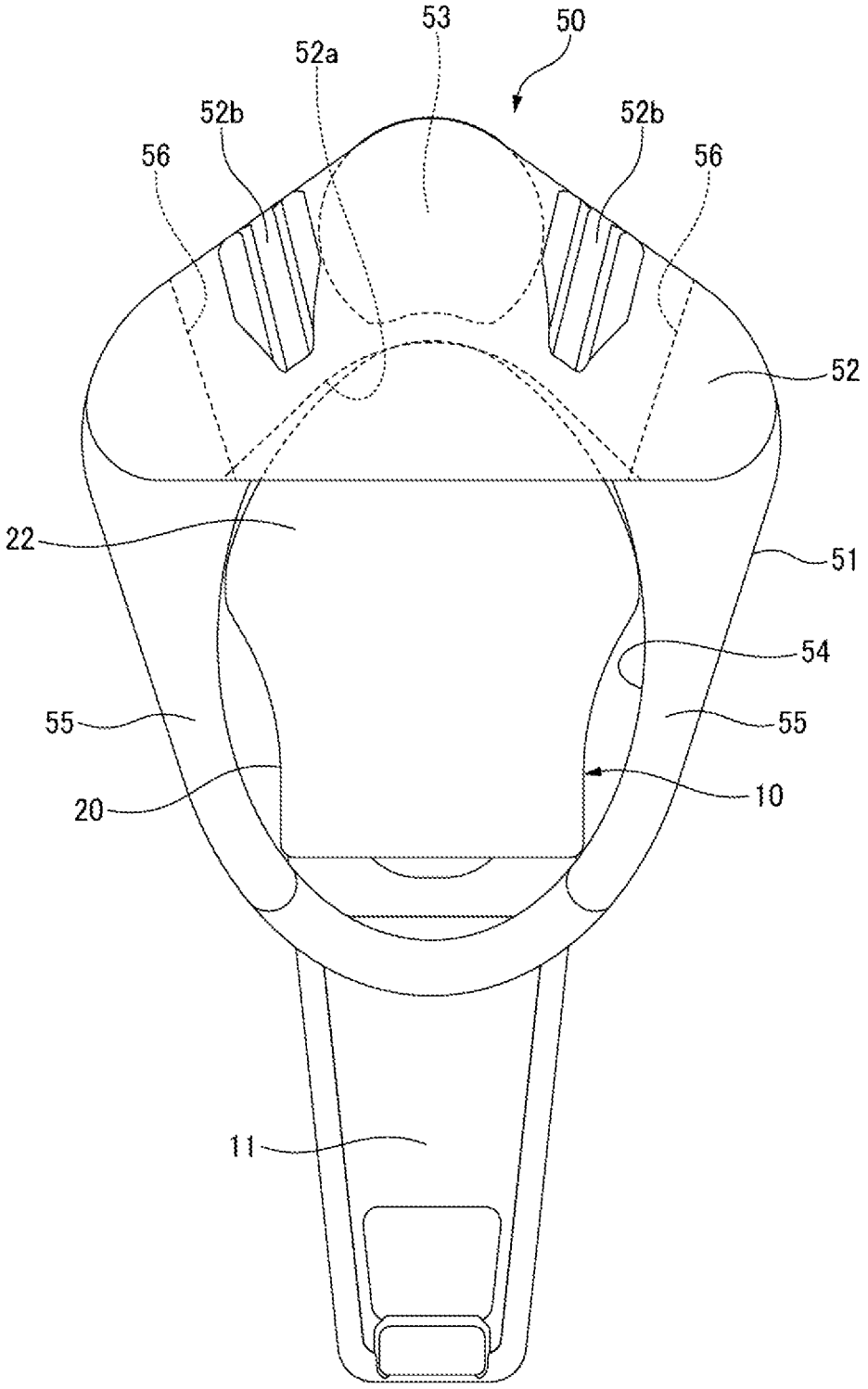
FIG. 6 is a bottom view of the slider cover attached to the slider.

Also, as shown in FIG. 5, a recess portion 52*a* configured to receive a front portion of the lower blade 22 of the slider 10 is formed on the upper surface of the lower plate 52. In addition, as shown in FIG. 6, a pair of right and left recessed grooves 52*b* are formed in a lower surface of the lower plate 52 along the pair of right and left element passages 56.

Also, as shown in FIGS. 3, 5 and 7, the lower plate 52 is comprised of a pair of right and left first lower plates 52*c* extending from the connecting post 53 outward in the width direction and a second lower plate 52*d* extending from the pair of right and left first lower plates 52*c* and having an upper surface formed downward below upper surfaces of the pair of right and left first lower plates 52*c*, and a stepped portion 52*e*, which can come in contact with the side wall 22*a* of the lower blade 22, is formed between inner surfaces of the first lower plates 52*c* and an inner surface of the second lower plate 52*d*.

Figure 9:
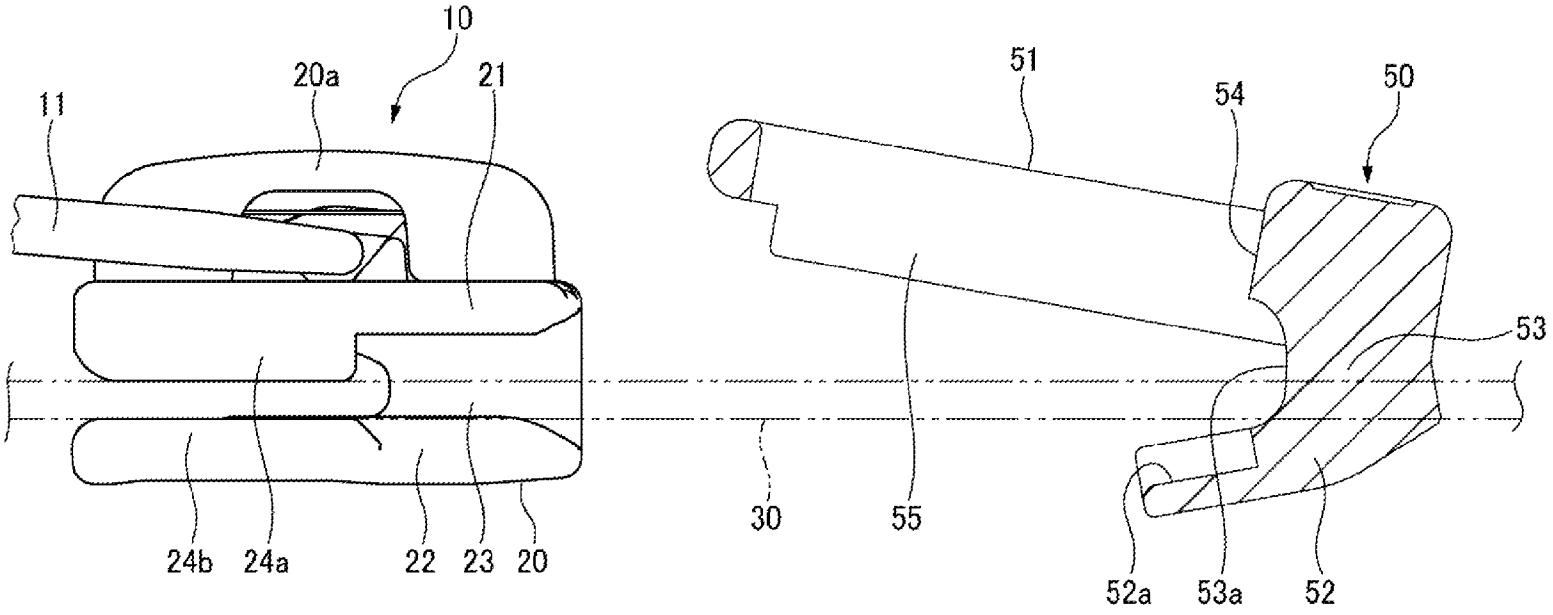
FIG. 9 is a side view explaining a state where the slider cover is being attached to the slider while widening between an upper plate and a lower plate of the slider cover.
Figure 10:
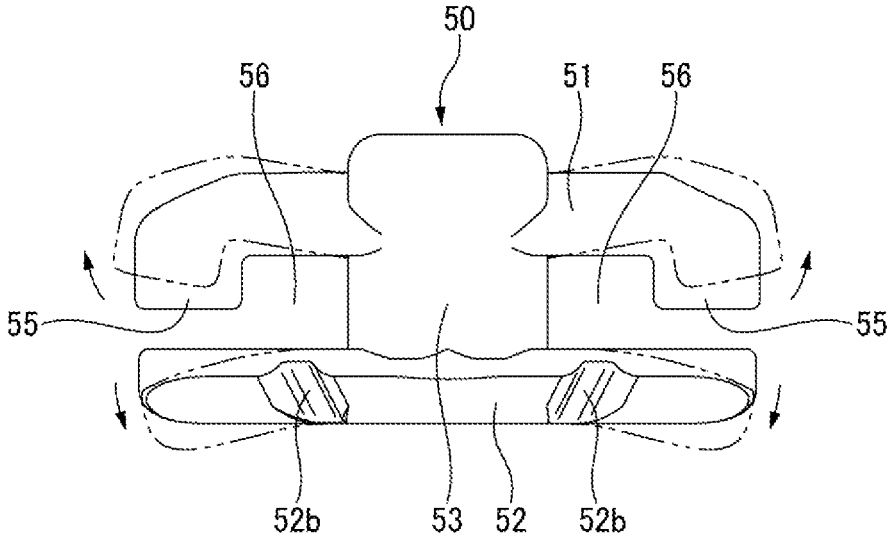
FIG. 10 is a front view of the slider cover in a state after widening the upper plate and the lower plate shown in FIG. 9.

Next, as for a method of attaching the slider cover 50 to the slider 10, as shown in FIGS. 9 and 10, the gap between the upper plate 51 and the lower plate 52 of the slider cover 50 is widened, and then the slider cover 50 is attached to the slider 10 from the front thereof so that slider 10 enters the widened gap. Also, as for another attaching method, upon assembling of the slide fastener 30, the slider 10 is fitted into the receiving portion 54 of the slider cover 50 from the upper side thereof (see FIG. 2), and then the slider cover 50 together with the slider 10 is mounted on the slide fastener 30.

In the slider cover 50 configured as described above, the fabric on the periphery of the slider 10 is separated into right and left sides of the slider cover 50 by a side surface of the upper plate 51 and a side surface of the lower plate 52 of the slider cover 50 upon sliding of the slider 10. Therefore, the fabric on the periphery of the slider 10 is prevented from entering the element guide path 27 of the slider 10, thereby preventing jamming of the fabric due to the slider 10.

As described above, according to the slider cover 50 of the present embodiment, the slider cover 50 includes the upper plate 51 and the lower plate 52, which are spaced apart from each other in the upward and downward direction and arranged in parallel to each other, and the connecting post 53 connecting the upper plate 51 with the lower plate 52, and the upper plate 51 has the receiving portion 54 configured to receive the upper blade 21 of the slider 10. Accordingly, the slider cover 50 can be simply attached to the slider 10 without performing a processing to the slider 10 and the fabric on the periphery of the slider 10 can be prevented from being jammed into the slider 10.

Also, according to the slider cover 50 of the present embodiment, the lower end edges of the cover-side flanges 55 of the slider cover 50 are arranged below the lower end edges of the upper flanges 24*a* of the slider 10. Accordingly, a gap between upper and lower flanges 24*a* and 24*b* of the slider 10 can be narrowed, so that the fabric on the periphery of the slider 10 can be further prevented from being jammed into the slider 10

Further, according to the slider cover 50 of the present embodiment, because the recess portion 52*a* configured to receive the front portion of the lower blade 22 of the slider 10 is formed on the upper surface of the lower plate 52, the slider 10 can be more securely held. Also, because a plate thickness of the lower plate 52 is reduced due to the recess portion 52*a*, the lower plate 52 can be easily deformed when the slider cover 50 is attached to the slider 10, thereby allowing the slider cover 50 to be further simply attached to the slider 10.

Further, according to the slider cover 50 of the present embodiment, the pair of right and left recessed grooves 52*b* are formed in the lower surface of the lower plate 52, thereby reducing the plate thickness of the lower plate 52. Accordingly, the lower plate 52 can be easily deformed when the slider cover 50 is attached to the slider 10, thereby allowing the slider cover 50 to be further simply attached to the slider 10.

In addition, according to the slider cover 50 of the present embodiment, because the angle θ of the entrance edge portion 56*a* of the element passages 56 with respect to the axis line L1 of the element passages 56 is set to be 90°±20°, the entrances of the element passages 56 can have the minimum width necessary. Therefore, it is difficult for the fabric on the periphery of the slider 10 to enter the element passages 56, thereby further preventing jamming of the fabric due to the slider 10.

Figure 11:
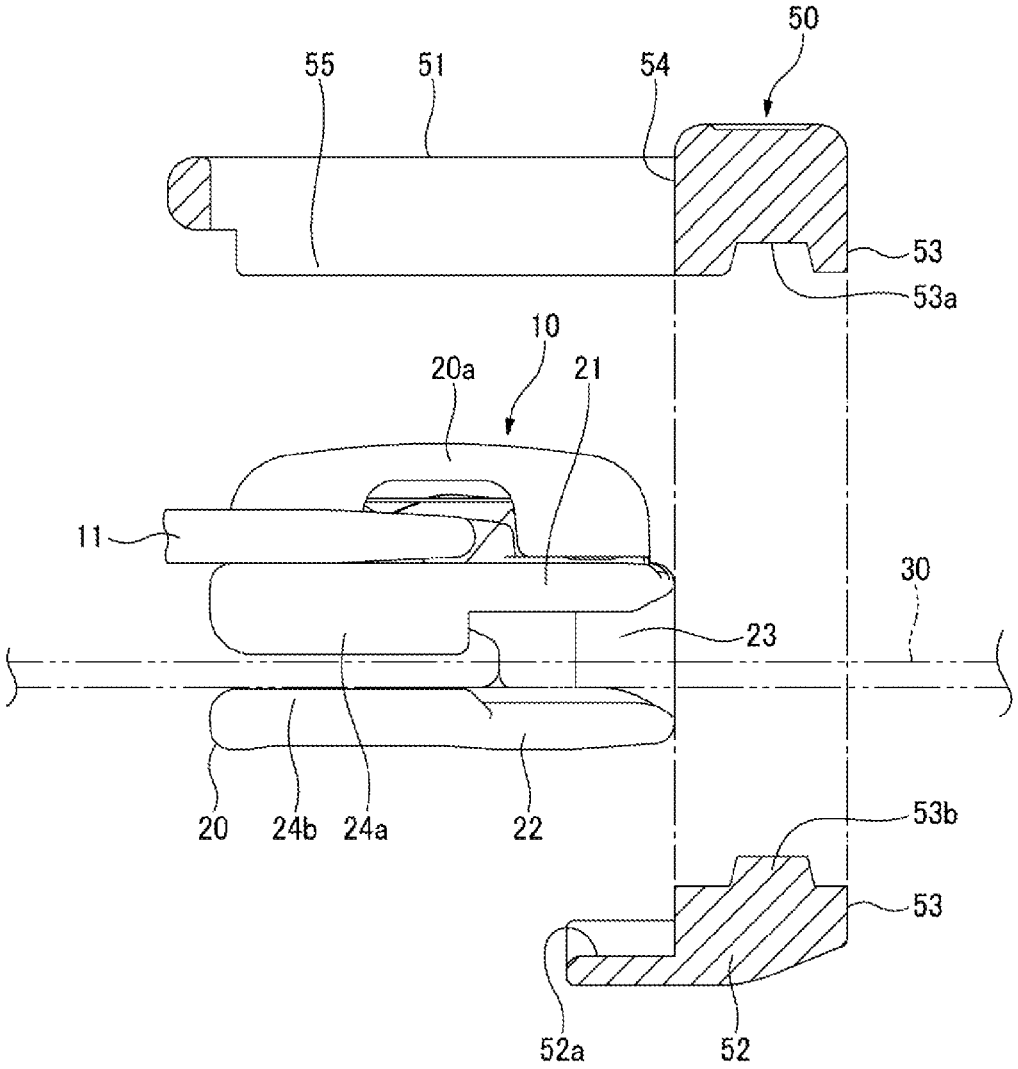
FIG. 11 is a longitudinal sectional view explaining a first variant of the slider cover of the first embodiment.

Alternatively, as a first variant of the present embodiment, as shown in FIG. 11, the connecting post 53 of the slider cover 50 may be divided into two upper and lower parts so that when the slider cover 50 is attached to the slider 10, the upper and lower parts of the connecting post 53 are bonded by adhesion, welding or the like. In this case, even if the slider cover 50 is made of hard synthetic resin, the slider cover 50 can be easily attached to the slider 10 of the slide fastener 30 after assembling. Also, in the present variant, a recess portion 53*a* is formed on a lower surface of the upper part of the divided connecting post 53 and a protrusion portion 53*b* to be fitted into the recess portion 53*a* is formed on an upper surface of the lower part of the divided connecting post 53. Alternatively, the recess portion 53*a* and the protrusion portion 53*b* may be reversely arranged. In addition, as for a method of bonding the upper and lower parts of the connecting post 53, instead of adhesion or welding as described above, for example, as shown in second to fourth embodiments described below, an engaging protrusion portion may be provided on one side thereof and an engaging recess portion may be provided on the other side so that they may be snapped and engaged to each other.

Figure 12:
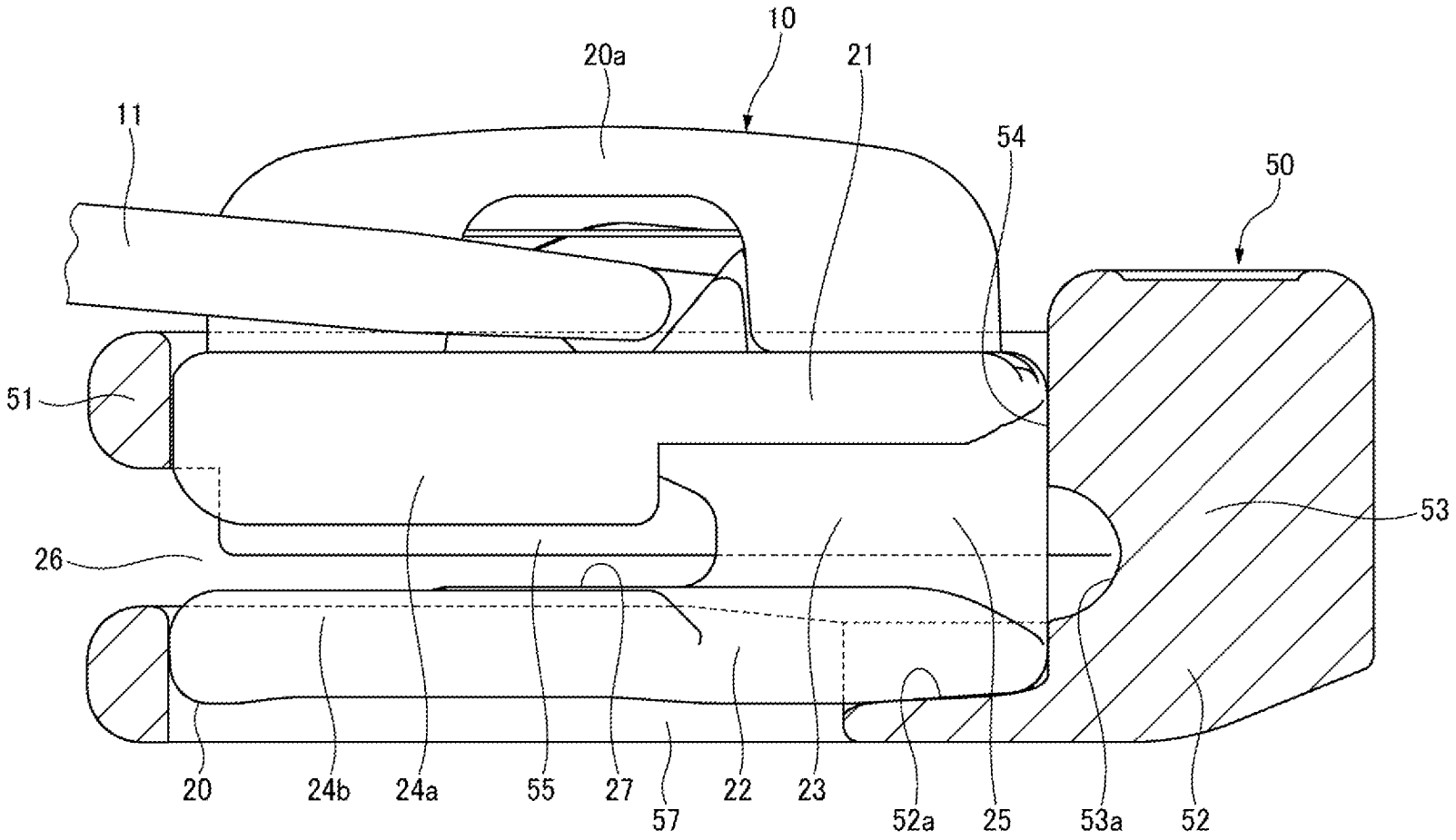
FIG. 12 is a longitudinal sectional view explaining a second variant of the slider cover of the first embodiment.

Alternatively, as a second variant of the present embodiment, as shown in FIG. 12, the lower plate 52 may be extended rearward and a receiving portion 57 configured to receive the lower blade 22 of the slider 10 may be formed on the lower plate 52, in addition to the receiving portion 54 of the upper plate 51. Like the receiving portion 54, the receiving portion 57 has an elliptical shape as viewed from the upper side and is formed to receive the entire circumference of the lower blade 22. According to the present variant, because the receiving portions 54 and 57 are respectively formed on the upper plate 51 and the lower plate 52, the slider 10 can be more securely held.

Alternatively, the slider cover 50 of the present embodiment may be used in other then the slider 10 in which the upper flange 24*a* is formed on the upper blade 21. For example, the slider cover may be also used in a slider of a slide fastener of a type in which fastener element rows are attached on back surfaces of fastener tapes, i.e., a slider in which a flange is formed on a lower blade. In this case, the cover-side flanges 55 to be formed on the slider cover 50 are not formed on the upper plate 51, but on the lower plate 52. Namely, the element passages 56 become sections defined by the lower surface of the upper plate 51, the upper surface of the lower plate 52, right and left cover-side flanges 55 extending from the lower plate 52 and side surfaces of the connecting post 53.

Second Embodiment

Next, a second embodiment of a slider cover for a slide fastener according to the present invention will be described with reference to FIGS. 13 to 15. Meanwhile, components identical or similar to those of the first embodiment are indicated by identical reference numerals in the figures, and the descriptions thereof will be omitted or simplified.

Figure 13:
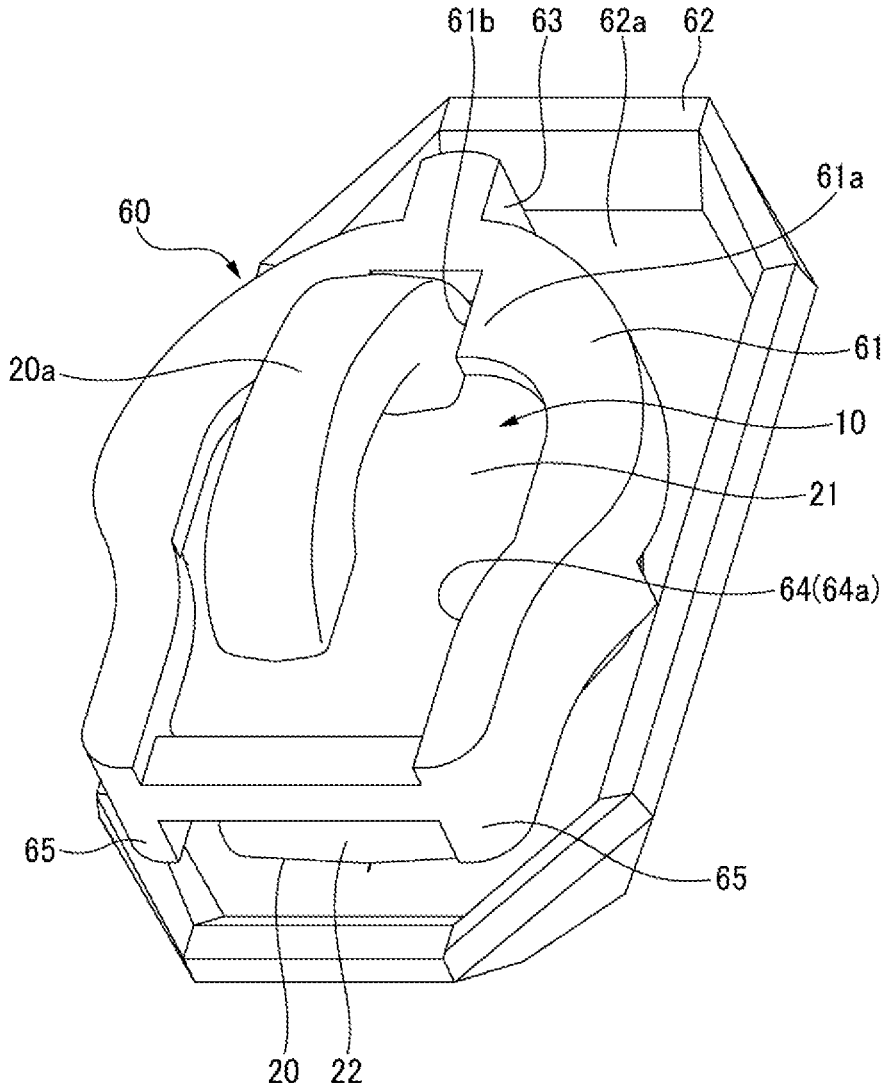
FIG. 13 is a perspective view explaining a state where a second embodiment of a slider cover according to the present invention is attached to a slider.
Figure 14:
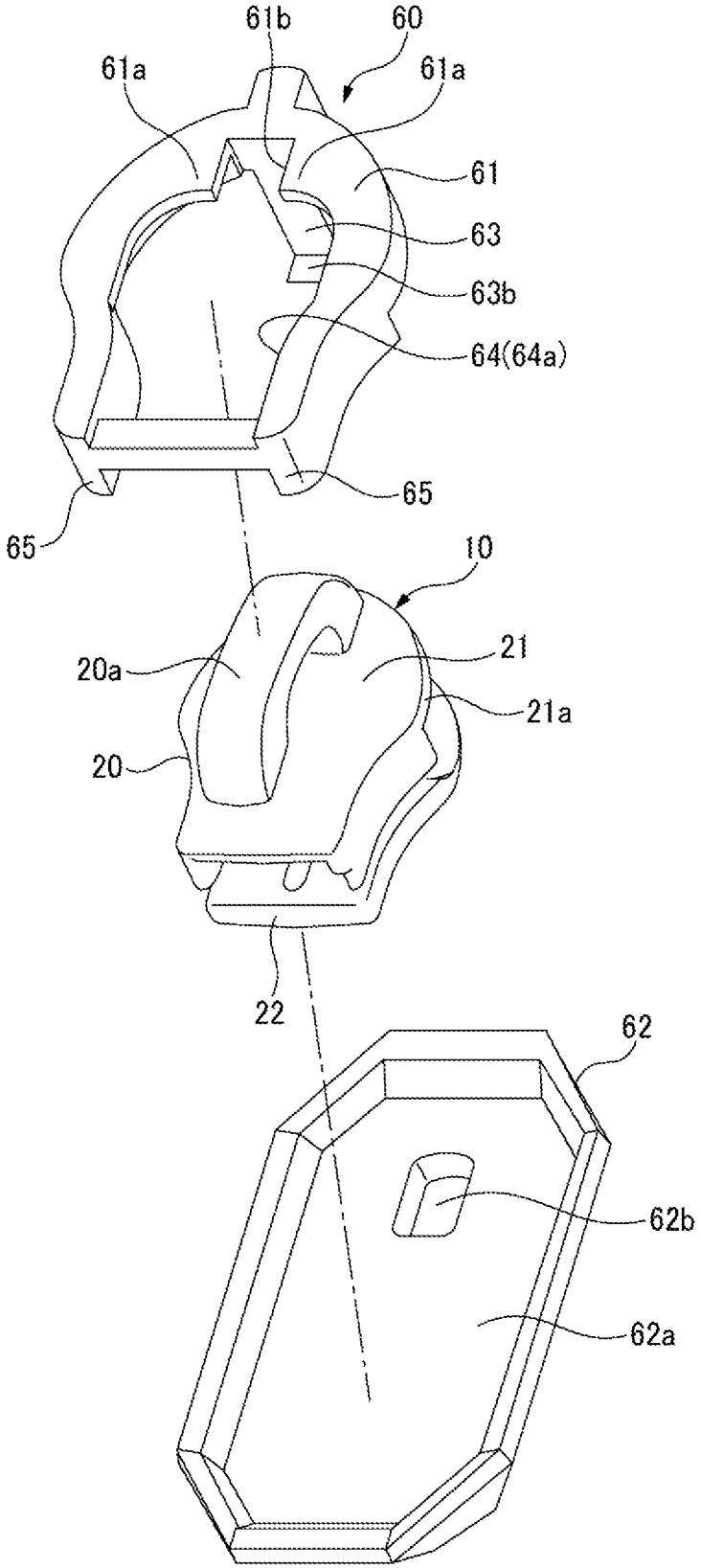
FIG. 14 is an exploded perspective view of the slider cover shown in FIG. 13.
Figure 15:
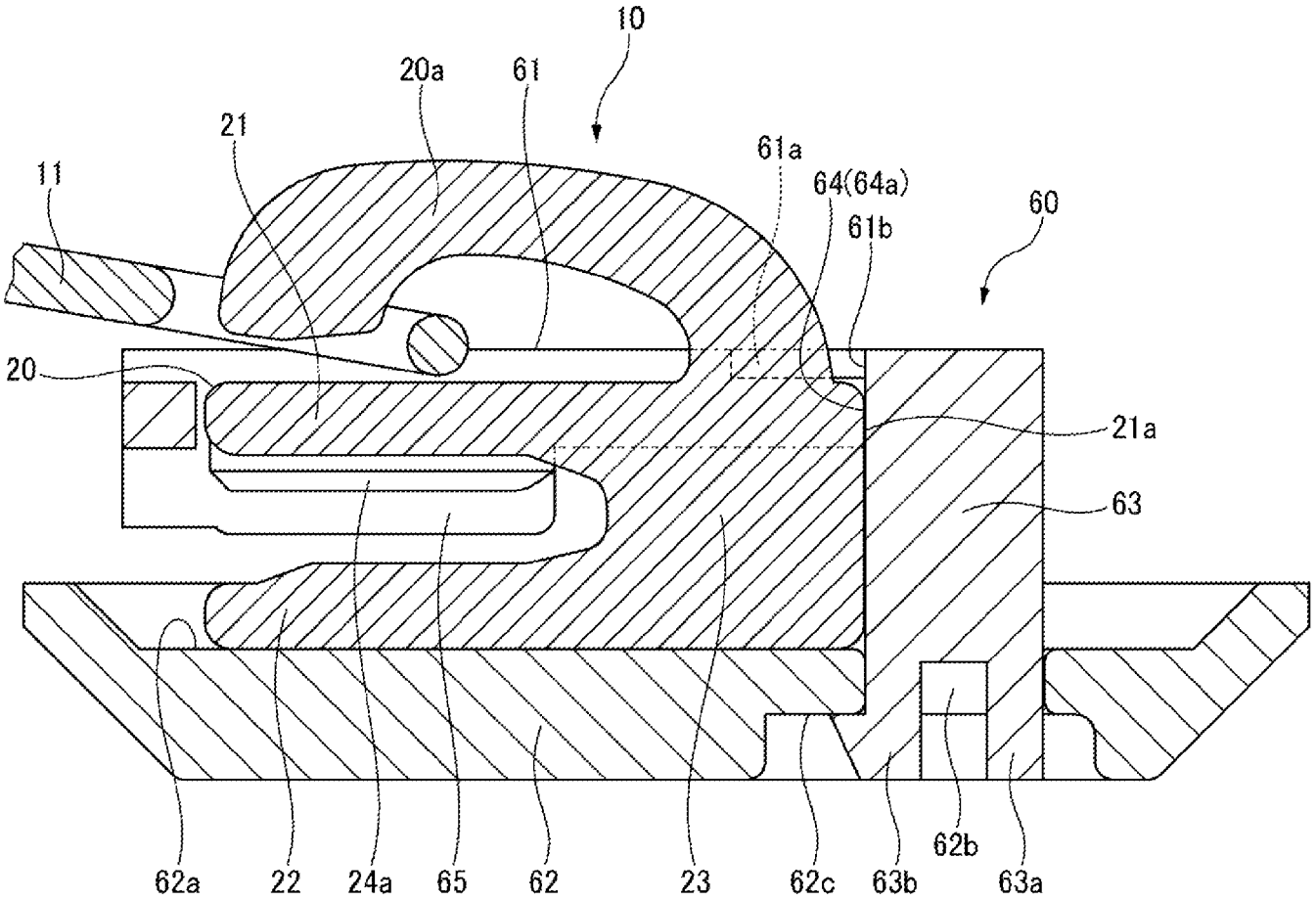
FIG. 15 is a longitudinal sectional view of the slider cover shown in FIG. 13.

As shown in FIGS. 13 to 15, the slider cover 60 of the present embodiment includes a upper plate (upper member, first member) 61 and a lower plate (lower member, second member) 62, which are spaced apart from each other in the upward and downward direction and arranged in parallel to each other, and a connecting post 63 connecting the upper plate 61 with the lower plate 62. In addition, the upper plate 61 has a receiving portion 64 configured to receive an upper blade 21 of a slider 10. Also, the connecting post 63 is formed to extend downward from a front end of the upper plate 61 and to be connected to the lower plate 62. Further, the slider cover 60 is formed of elastomer or synthetic resin. Meanwhile, the slider 10 of the present embodiment is a slider, which does not have an automatic stop function.

The upper plate 61 has a upper surface and a lower surface, and the receiving portion 64 is a hole portion penetrating through the upper and lower surfaces of the upper plate 61 and is formed to receive the entire circumference of the upper blade 21. Also, the receiving portion 64 has an inner surface 64*a* for defining the hole portion, and the inner surface 54*a* receives the upper blade 21 so as to come in contact with the entire circumference of a side wall 21*a* of the upper blade 21. Therefore, as shown in FIGS. 13 and 15, the entire circumference of the side wall 21*a* of the upper blade 21 is surrounded by the inner surface 64*a* of the receiving portion 64 and thus the slider cover 60 is held on the slider 10.

Also, in a state where the slider cover 60 is held on the slider 10, the upper surface of the upper plate 61 and an upper surface of the upper blade 21 are positioned at approximately the same height. Therefore, the pull tab attachment portion 20*a* provided on the upper surface of the upper blade 21 and the pull tab 11 attached to the pull tab attachment portion 20*a* are arranged above the upper plate 61 and thus the pull tab 11 can be operated above the upper plate 61. Accordingly, when sliding the slider 10, the inner surface 64*a* of the receiving portion 64 of the slider cover 60 comes in contact with the side wall 21*a* of the upper blade 21 only by operating the pull tab 11, and thus the slider cover 60 can be moved to correspond to movement of the slider 10.

Also, on a front end portion of the receiving portion 64, a pair of right and left plate portions 61*a* configured to come in contact with the upper surface of the upper blade 21 of the slider 10 is integrally formed with the upper plate 61. In addition, a recess portion 61*b*, into which a base portion of the pull tab attachment portion 20*a* of the slider 10 is fitted, is formed between the pair of right and left plate portions 61*a*.

The lower plate 62 is formed in a generally ship shape and has on the upper surface thereof a recess portion 62*a* formed configured to receive the lower blade 22 of the slider 10. Also, the lower plate 62 is provided with a connecting hole (engaging recess portion) 62*b* configured to connect with the connecting post 63 and having a generally rectangular shape as viewed from the upper side.

The connecting post 63 is formed in a generally rectangular cross-sectional shape to be inserted into the connecting hole 62*b* of the lower plate 62. In addition, as shown in FIG. 15, a restriction portion 63*a* configured to be inserted into the connecting hole 62*b* of the lower plate 62 and thus to restrict a relative rotation between the upper plate 61 and the lower plate 62 is formed on a front portion of a lower end of the connecting post 63. Also, an engaging portion (engaging protrusion portion) 63*b* configured to be inserted into the connecting hole 62*b* of the lower plate 62 and thus to be snapped and engaged in the connecting hole 62*b* of the lower plate 62 is formed on a rear portion of the lower end of the connecting post 63.

Also, a receiving recess portion 62*c* configured to receive the restriction portion 63*a* and the engaging portion 63*b* is formed on the lower surface of the lower plate 62. In addition, due to the receiving recess portion 62*c*, the restriction member 63*a* and the engaging portion 63*b* are configured not to protrude below the lower surface of the lower plate 62.

Further, the slider cover 60 has cover-side flanges 65 formed along both right and left side edges of the upper plate 61 to protrude downward. In addition, as shown in FIG. 15, lower end edges of the cover-side flanges 65 are arranged below lower end edges of the upper flanges 24*a* of the slider 10.

Next, as for a method of attaching the slider cover 60 to the slider 10, as shown in FIG. 14, after the upper plate 61 and the lower plate 62 are arranged on top of one another with the slider 10 interposed therebetween, the connecting post 63 of the upper plate 61 is inserted into the connecting hole 62*b* of the lower plate 62 and then the engaging portion 63*b* of the connecting post 63 is snapped and engaged into the connecting hole 62*b*, thereby attaching the slider cover 60 to the slider 10.

In the slider cover 60 configured as described above, a fabric on the periphery of the slider 10 is separated into right and left sides of the slider cover 60 by a side surface of the upper plate 61 and a side surface of the lower plate 62 of the slider cover 60 upon sliding of the slider 10. Therefore, the fabric on the periphery of the slider 10 is prevented from entering the element guide path 27 of the slider 10, thereby preventing jamming of the fabric due to the slider 10.

As described above, according to the slider cover 60 of the present embodiment, the slider cover 60 includes the upper plate 61 and the lower plate 62, which are spaced apart from each other in the upward and downward direction and arranged in parallel to each other, and the connecting post 63 connecting the upper plate 61 with the lower plate 62, and the upper plate 61 has the receiving portion 64 configured to receive the upper blade 21 of the slider 10. Accordingly, the slider cover 60 can be simply attached to the slider 10 without performing a processing to the slider 10 and the fabric on the periphery of the slider 10 can be prevented from being jammed into the slider 10.

Also, according to the slider cover 60 of the present embodiment, the lower end edges of the cover-side flanges 65 of the slider cover 60 are arranged below the lower end edges of the upper flanges 24*a* of the slider 10. Accordingly, a gap between upper and lower flanges 24*a* and 24*b* of the slider 10 can be narrowed, so that the fabric on the periphery of the slider 10 can be further prevented from being jammed into the slider 10.

The other configurations and the effects thereof are identical to those of the first embodiment.

In the foregoing, as the first and second embodiments, the slider cover 50 having a function of preventing jamming of a fabric in order to impart an additional function to the slider 10 has been described. Meanwhile, the second embodiment has also a cool feeling prevention function as described below, in addition to the jamming prevention function. Particularly, when the slider 10 is made of metal and the slide fastener is used in flies of clothes or the like, a user is likely to feel a cool feeling if a back surface of the metal slider 10 is touched to a human skin. However, because the slider cover 50 is attached to the slider 10 to cover a part or all of the guide post 23 or the lower blade 22 of the slider 10, it is possible to prevent the metal part of the slider 10 from being touched to the human skin.

Third Embodiment

Next, a third embodiment of a slider cover for a slide fastener according to the present invention will be described with reference to FIGS. 16 to 22. Meanwhile, components identical or similar to those of the first embodiment are indicated by identical reference numerals in the figures, and the descriptions thereof will be omitted or simplified.

As shown in FIGS. 16 to 19, the slider cover 70 includes a upper plate (upper member, first member) 71 and a lower plate (lower member, second member) 72, which are spaced apart from each other in the upward and downward direction and arranged in parallel to each other, and a connecting post 73 connecting the upper plate 71 with the lower plate 72. In addition, the upper plate 71 has a receiving portion 74 configured to receive an upper blade 21 of a slider 10. Also, the connecting post 73 is formed to extend downward from a front end of the upper plate 71 and to be connected to the lower plate 72. Further, the slider cover 70 is formed of elastomer or synthetic resin.

Figure 16:
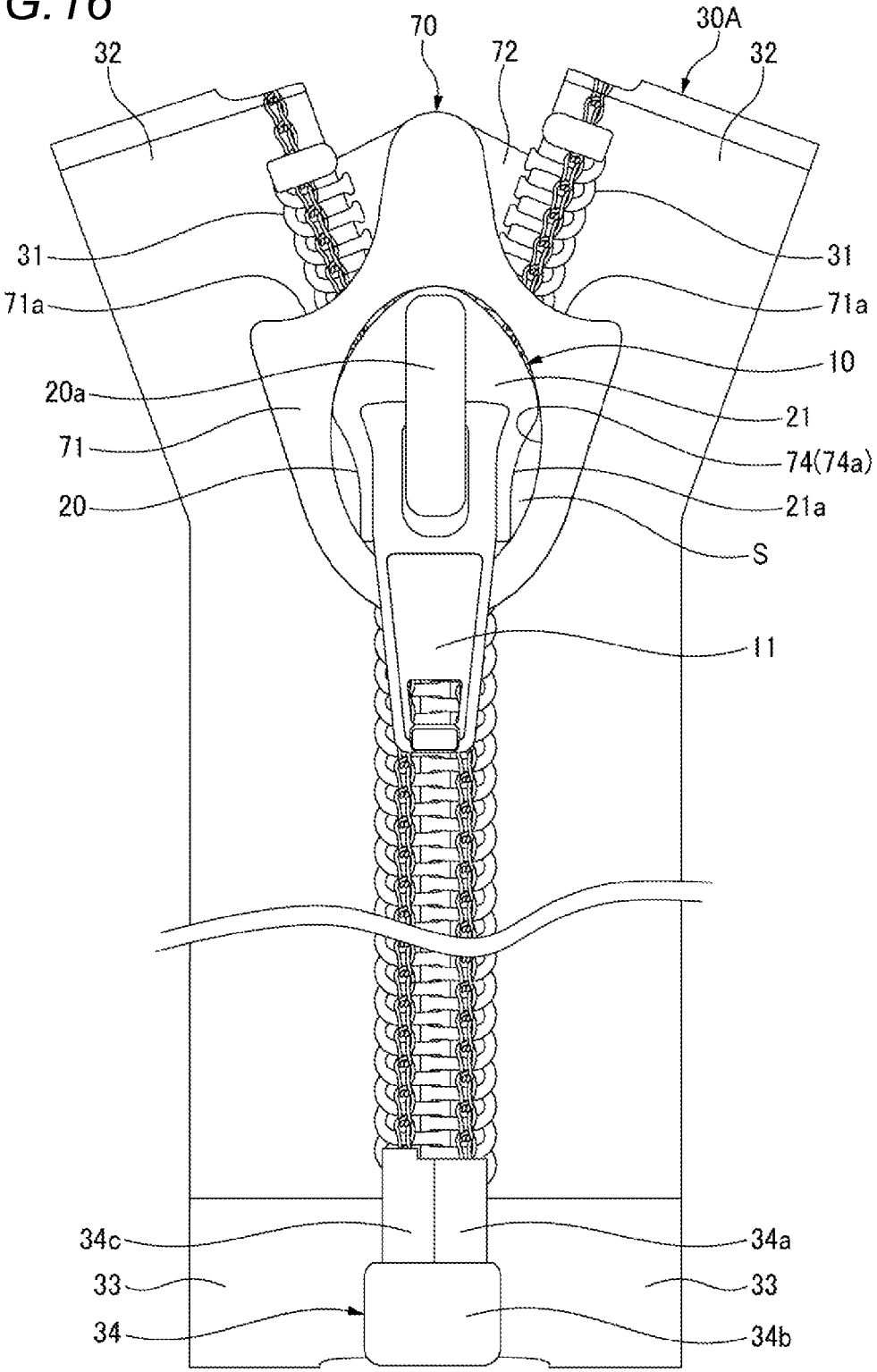
FIG. 16 is a front surface view of a slide fastener in a state where a third embodiment of a slider cover according to the present invention is attached to a slider.

Meanwhile, the slider cover 70 is used in a slide fastener 30A having a separable end stop as shown in FIG. 16. The separable end stop 34 of the slide fastener 30A includes a box pin 34*a* and a box body 34*b* attached to an end of one fastener element row 31 and an insert pin 34*c* attached to an end of the other fastener element row 31. Also, the insert pin 34*c* can be inserted into the box body 34*b*, and right and left fastener element rows 31 are engaged with each other by pulling up the slider 10 in a state where the insert pin 34 has been inserted in the box body 34*b*. Also, reinforcing films 33 are affixed to right and left fastener tapes 32 on both sides of the separable end stop 34.

The upper plate 71 has a upper surface and a lower surface, and the receiving portion 74 is a hole portion penetrating through the upper and lower surfaces of the upper plate 71 and having an elliptical shape as viewed from the upper side and is formed to receive the entire circumference of the upper blade 21. Also, the receiving portion 74 has an inner surface 74*a* for defining the hole portion, and a part of the inner surface 74*a* receives the upper blade 21 so as to come in contact with a part of a side wall 21*a* of the upper blade 21. Therefore, as shown in FIG. 16, the side wall 21*a* of the upper blade 21 is surrounded by the inner surface 74*a* of the receiving portion 74 and thus the slider cover 70 is held on the slider 10.

Also, in a state where the slider cover 70 is held on the slider 10, the upper surface of the upper plate 71 and an upper surface of the upper blade 21 are positioned at approximately the same height. Therefore, the pull tab attachment portion 20*a* provided on the upper surface of the upper blade 21 and the pull tab 11 attached to the pull tab attachment portion 20*a* are arranged above the upper plate 71 and thus the pull tab 11 can be operated above the upper plate 51. Accordingly, when sliding the slider 10, the inner surface 74*a* of the receiving portion 74 of the slider cover 70 comes in contact with the side wall 21*a* of the upper blade 21 only by operating the pull tab 11, and thus the slider cover 70 can be moved to correspond to movement of the slider 10.

In addition, the receiving portion 74 is formed to be larger than the upper blade 21, and as shown in FIG. 16, a gap S is formed between the inner surface 74*a* of the receiving portion 74 and the side wall 21*a* of the upper blade 21 in a state where the slider cover 70 is attached to the slider 10. Also, the gap S is particularly formed to be larger in a width direction of the slider 10 so that the slider 10 can be easily received in the receiving portion 74 of the slider cover 70.

Figure 18:
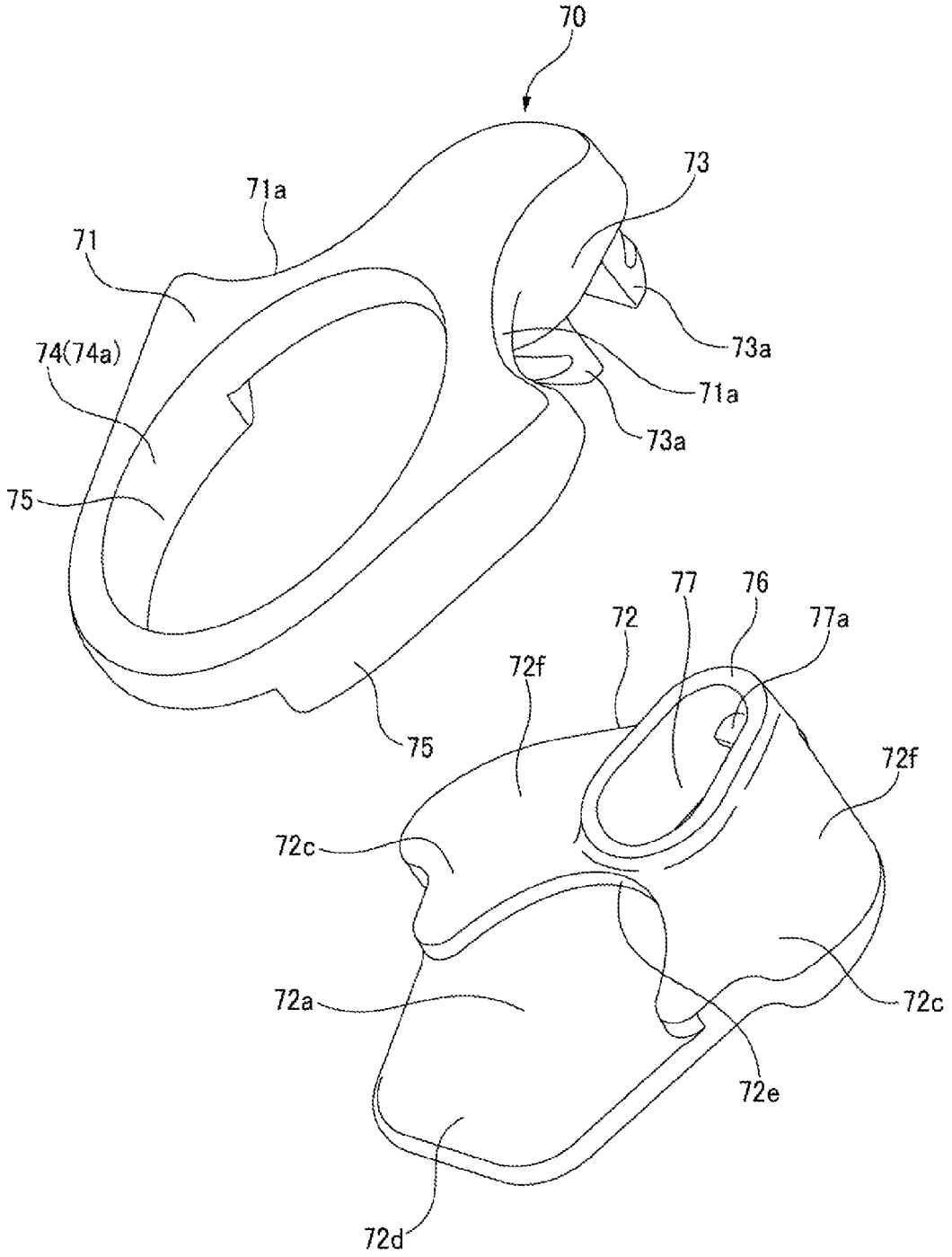
FIG. 18 is an exploded perspective view of the slider cover shown in FIG. 16.
Figure 19:
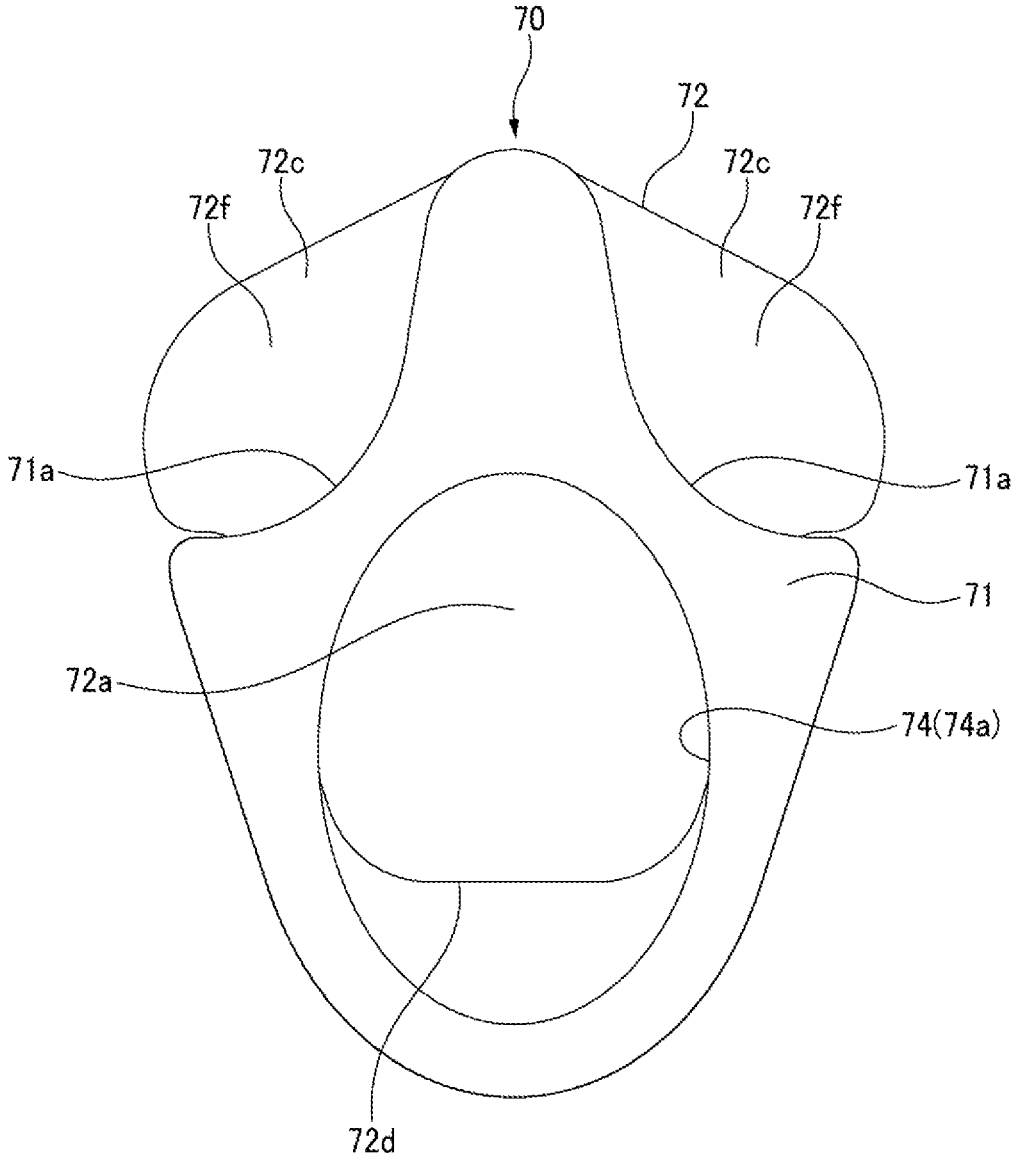
FIG. 19 is a top view of the slider cover shown in FIG. 16.

Also, as shown in FIGS. 18 and 19, the slider cover 70 includes a pair of right and left cut-out portions 71 formed on right and left sides of a front portion of the upper plate 71 with the connecting post 73 interposed therebetween, and cover-side flanges 75 formed along both right and left side edges of the upper plate 71 to protrude downward. More specifically, the cover-side flanges 75 are provided on both sides of the receiving portion 74 in a width direction thereof and extend from the lower surface of the upper plate 71 toward the lower plate 72. Also, inner surfaces of the cover-side flanges 75 are the same surface as the inner surface 74*a* of the receiving portion 74, and the cover-side flanges 75 are formed to extend from a front end to a rear end of the upper plate 71.

Further, as shown in FIG. 18, a recess portion 72*a* configured to receive a part of the lower blade 22 of the slider 10 is formed on the upper surface of the lower plate 72. In addition, a connection portion 76 having a connecting hole (engaging recess portion) 77 configured to connect with the connecting post 73 is formed on a front end of the lower plate 72.

Also, as shown in FIG. 18, the lower plate 72 is comprised of a pair of right and left first lower plates 72*c* extending from the connecting post 73 outward in the width direction and a second lower plate 72*d* extending from the pair of right and left first lower plates 72*c* and having an upper surface formed downward below upper surfaces of the pair of right and left first lower plates 72*c*, and a stepped portion 72*e*, which can come in contact with the side wall 22*a* of the lower blade 22, is formed between inner surfaces of the first lower plates 72*c* and an inner surface of the second lower plate 72*d*.

Further, as shown in FIG. 19, each of the pair of right and left first lower plate 72*c* is formed to extend forward beyond the upper plate 71. Namely, front ends of the first lower plates 72*c* are located forward beyond a front end of the upper plate 71. In addition, as shown in FIG. 18, inner surfaces of the pair of right and left first lower plates 72*c* have an inclined surface 72*f* inclined forward and downward from a rear end portion of the inner surface.

Figure 17:
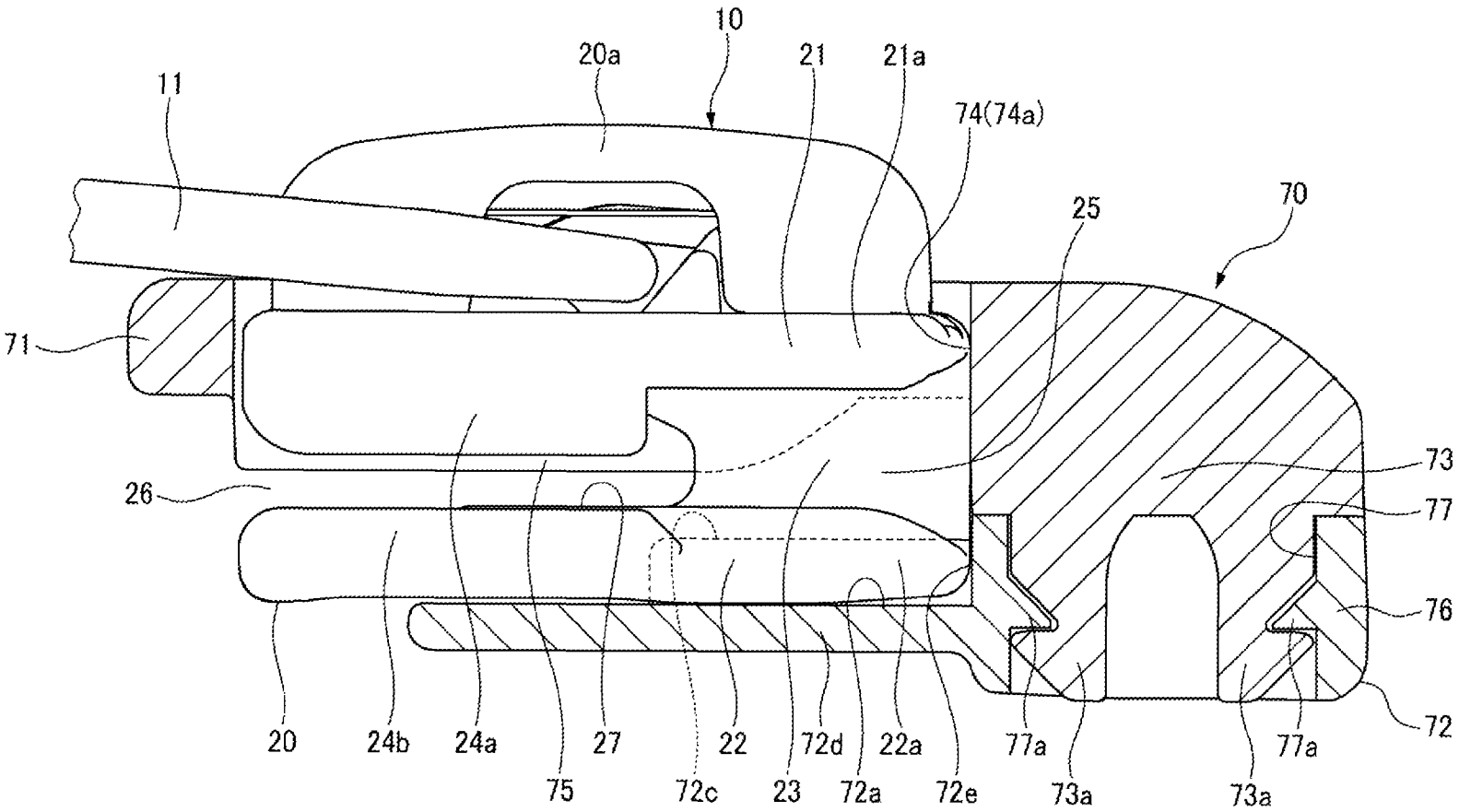
FIG. 17 is a longitudinal sectional view of the slider cover shown in FIG. 16.

The connecting post 73 is of a generally elliptical cross-sectional shape, and as shown in FIGS. 17 and 18, a pair of front and rear engaging portions (engaging protrusion portions) 73*a* configured to be inserted into the connecting hole 77 of the connection portion 76 and thus to be respectively snapped and engaged to front and rear engaging protrusions 77*a* inside the connecting hole 77 is formed on a lower end of the connecting post 73.

Figure 20:
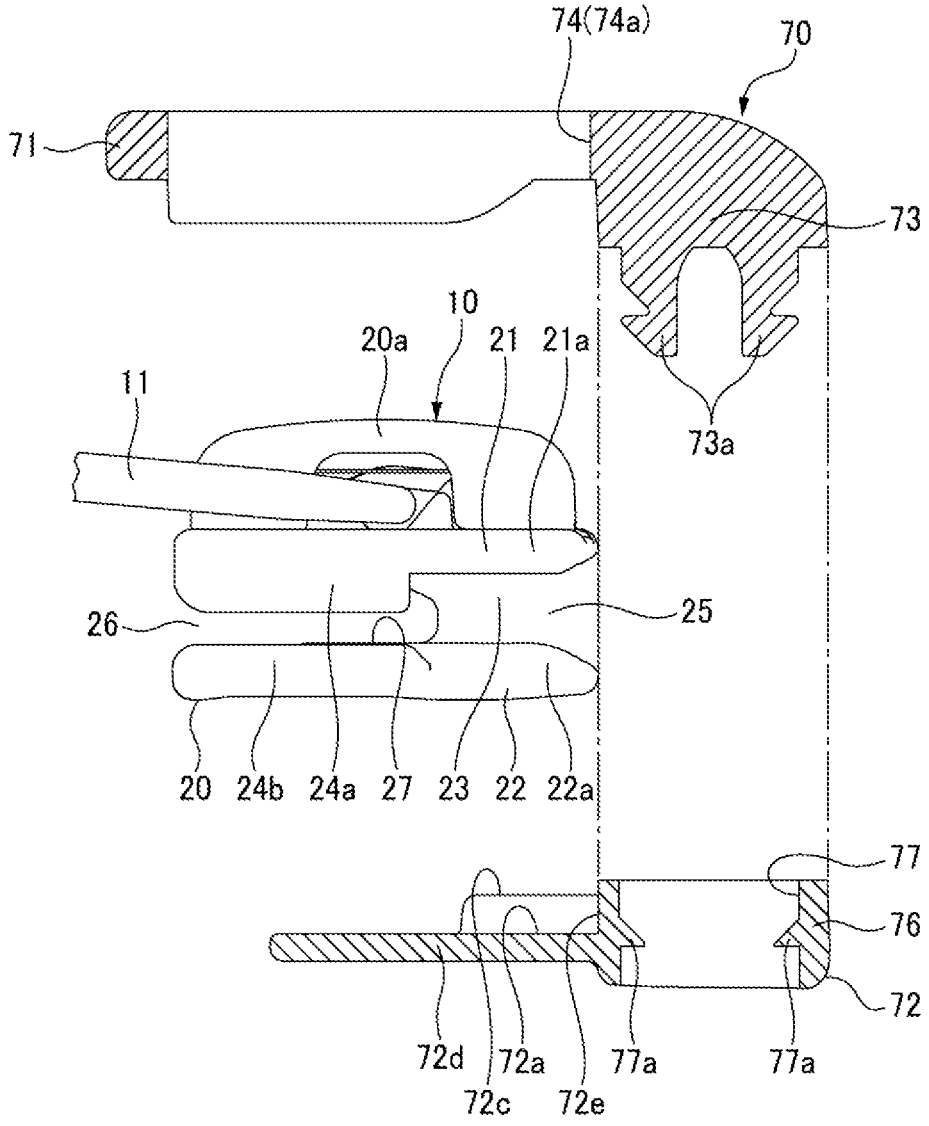
FIG. 20 is an exploded longitudinal sectional view of the slider cover shown in FIG. 17.
Figure 21:
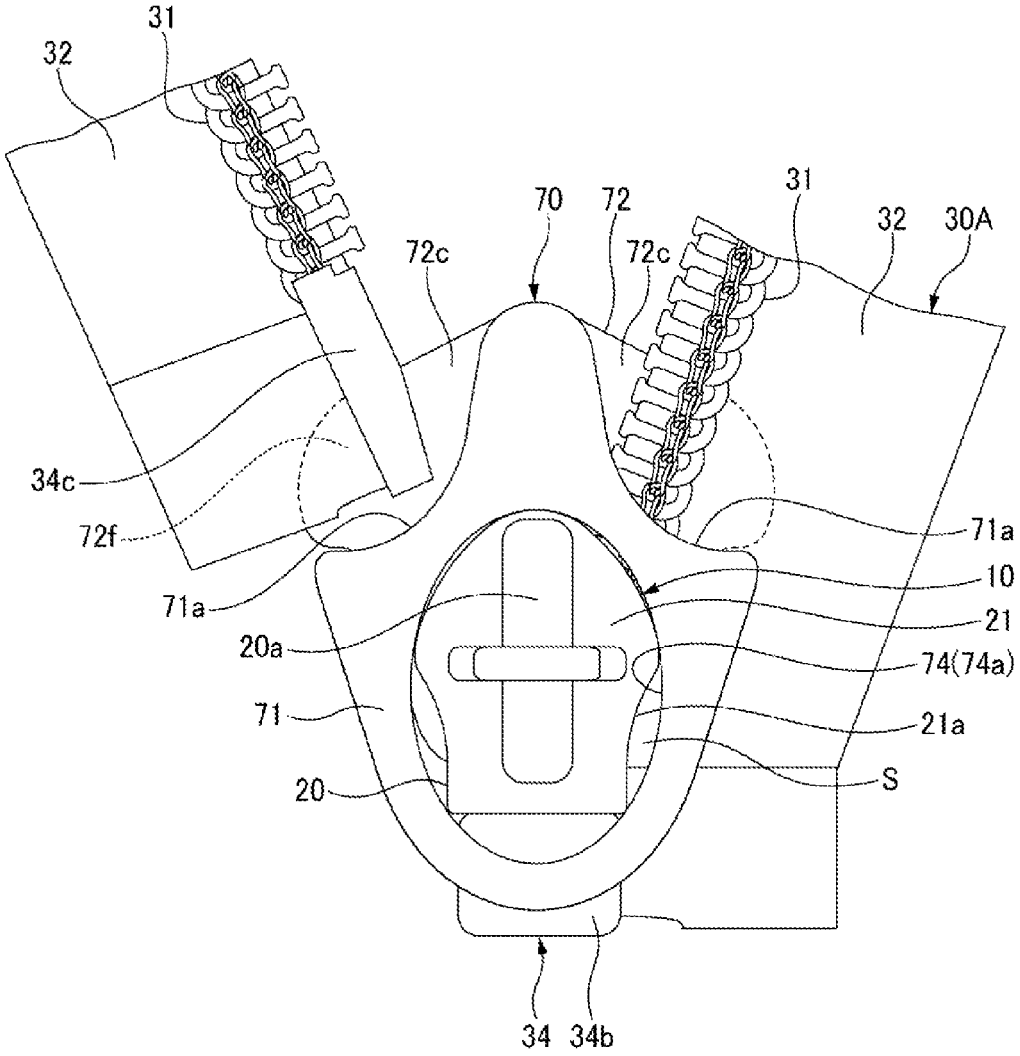
FIG. 21 is a top view explaining a state where an insert pin of a separable end stop is being guided into an element guide path of the slider by an inclined surface of a first lower plate thereof.
Figure 22:
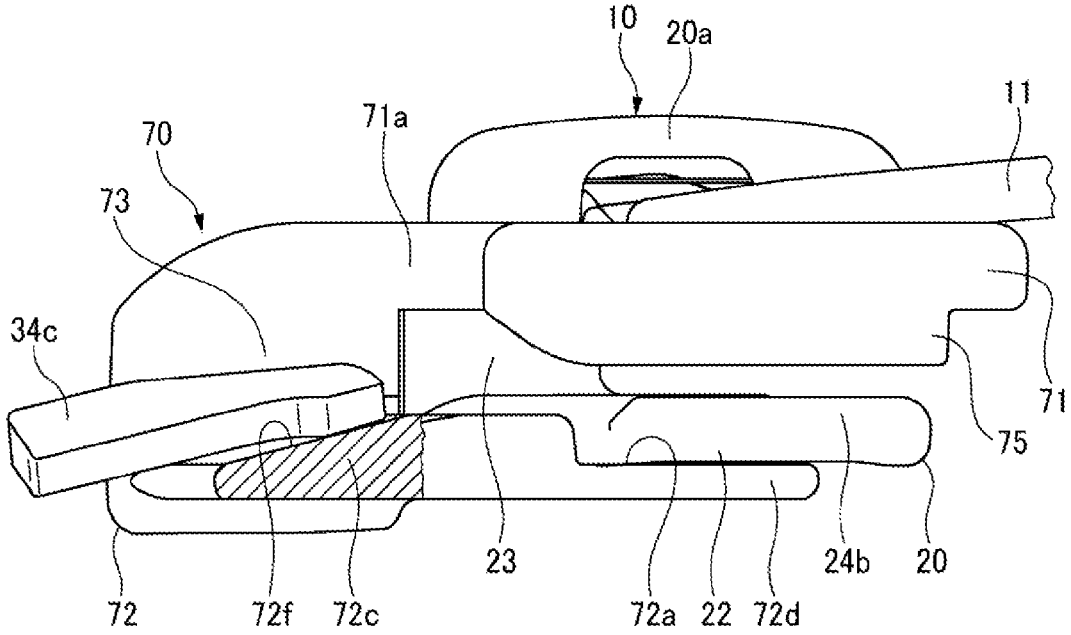
FIG. 22 is a partially cut-away left side view explaining the state shown in FIG. 21.

Next, as for a method of attaching the slider cover 70 to the slider 10, as shown in FIG. 20, the upper plate 71 and the lower plate 72 are arranged on top of one another with the slider 10 interposed therebetween, and then the engaging portions 73*a* of the connecting post 73 of the upper plate 71 are snapped and engaged to the engaging protrusions 77*a* of the connecting hole 77 of the lower plate 72, thereby attaching the slider cover 70 to the slider 10.

In this case, attaching the slider cover 70 to the slider 10 may be performed before the slider 10 is inserted onto the pair of fastener element rows 31, but preferably after the slider 10 has inserted onto the pair of fastener element rows 31, more preferably after the slide fastener 30A has been attached to an attached body, such as clothes. Thus, the slider cover 70 does not hinder inserting of the slider or attaching to the attached body. Meanwhile, it is noted that this effect is the same in all embodiments of the present invention.

In the slider cover 70 configured as described above, as shown in FIGS. 21 and 22, when the insert pin 34*c* of the separable end stop 34 is inserted into the box body 34*b*, the insert pin 34*c* is guided into the element guide path 27 of the slider 10 by the inclined surface 72*f* of the left first lower plate 72*c* of the lower plate 72 of the slider cover 70. Thus, the insert pin 34*c* of the separable end stop 34 can be easily inserted into the box body 34*b*.

In this case, a color scheme of portions of the first lower plates 72*c*, which are extended forward beyond the upper plate 71, may be configured to have a color different from those of a color scheme of the slide fastener 30A or the slider cover 70 except the extended first lower plates 72*c*, preferably to have a more brilliant color, such as fluorescent colors. Thus, aged or partially-sighted people can easily guide the insert pin 34*c* into the element guide path 27 of the slider 10.

As described above, according to the slider cover 70 of the present embodiment, the slider cover 70 includes the upper plate 71 and the lower plate 72, which are spaced apart from each other in the upward and downward direction and arranged in parallel to each other, and the connecting post 73 connecting the upper plate 71 with the lower plate 72, and the upper plate 71 has the receiving portion 74 configured to receive the upper blade 21 of the slider 10. Accordingly, the slider cover 70 can be simply attached to the slider 10 without performing a processing to the slider 10 and also the insert pin 34*c* of the separable end stop 34 can be easily inserted into the box body 34*b*.

Alternatively, although in the present embodiment, the lower plate 72 is provided with the pair of right and left first lower plates 72*c*, the present invention is not limited to that, and the first lower plate 72*c* may be provided on either one of right and left sides if a side, into which the insert pin 34*c* is to be inserted, has been determined.

The other configurations and the effects thereof are identical to those of the first embodiment.

In the foregoing, as the third embodiment, the slider cover 70 having a function of guiding the insert pin in order to impart an additional function to the slider 10 has been described. Meanwhile, like the first embodiment, the third embodiment has also a cool feeling prevention function as described below, in addition to the function of guiding the insert pin.

Fourth Embodiment

Next, a fourth embodiment of a slider cover for a slide fastener according to the present invention will be described with reference to FIGS. 23 to 25. Meanwhile, components identical or similar to those of the first embodiment are indicated by identical reference numerals in the figures, and the descriptions thereof will be omitted or simplified.

As shown in FIGS. 22 to 25, the slider cover 80 includes a upper plate (upper member, first member) 81 and a lower plate (lower member, second member) 82, which are spaced apart from each other in the upward and downward direction and arranged in parallel to each other, and a connecting post 83 connecting the upper plate 81 with the lower plate 82. In addition, the upper plate 81 has a receiving portion 84 configured to receive an upper blade 21 of a slider 10. Also, the connecting post 83 is formed to extend downward from a front end of the upper plate 81 and to be connected to the lower plate 82. Further, the slider cover 80 is formed of elastomer or synthetic resin. In the present embodiment, the slider 10 is made of metal.

The upper plate 81 has a upper surface and a lower surface, and the receiving portion 84 is a hole portion penetrating through the upper and lower surfaces of the upper plate 81 and having an elliptical shape as viewed from the upper side and is formed to receive the entire circumference of the upper blade 21. Also, the receiving portion 84 has an inner surface 84*a* for defining the hole portion, and a part of the inner surface 84*a* receives the upper blade 21 so as to come in contact with a part of a side wall 21*a* of the upper blade 21. Therefore, as shown in FIG. 23, the side wall 21*a* of the upper blade 21 is surrounded by the inner surface 84*a* of the receiving portion 84 and thus the slider cover 80 is held on the slider 10.

Also, in a state where the slider cover 80 is held on the slider 10, the upper surface of the upper plate 81 and an upper surface of the upper blade 21 are positioned at approximately the same height. Therefore, the pull tab attachment portion 20*a* provided on the upper surface of the upper blade 21 and the pull tab 11 attached to the pull tab attachment portion 20*a* are arranged above the upper plate 81 and thus the pull tab 11 can be operated above the upper plate 81. Accordingly, when sliding the slider 10, the inner surface 84*a* of the receiving portion 84 of the slider cover 80 comes in contact with the side wall 21*a* of the upper blade 21 only by operating the pull tab 11, and thus the slider cover 80 can be moved to correspond to movement of the slider 10.

Figure 23:
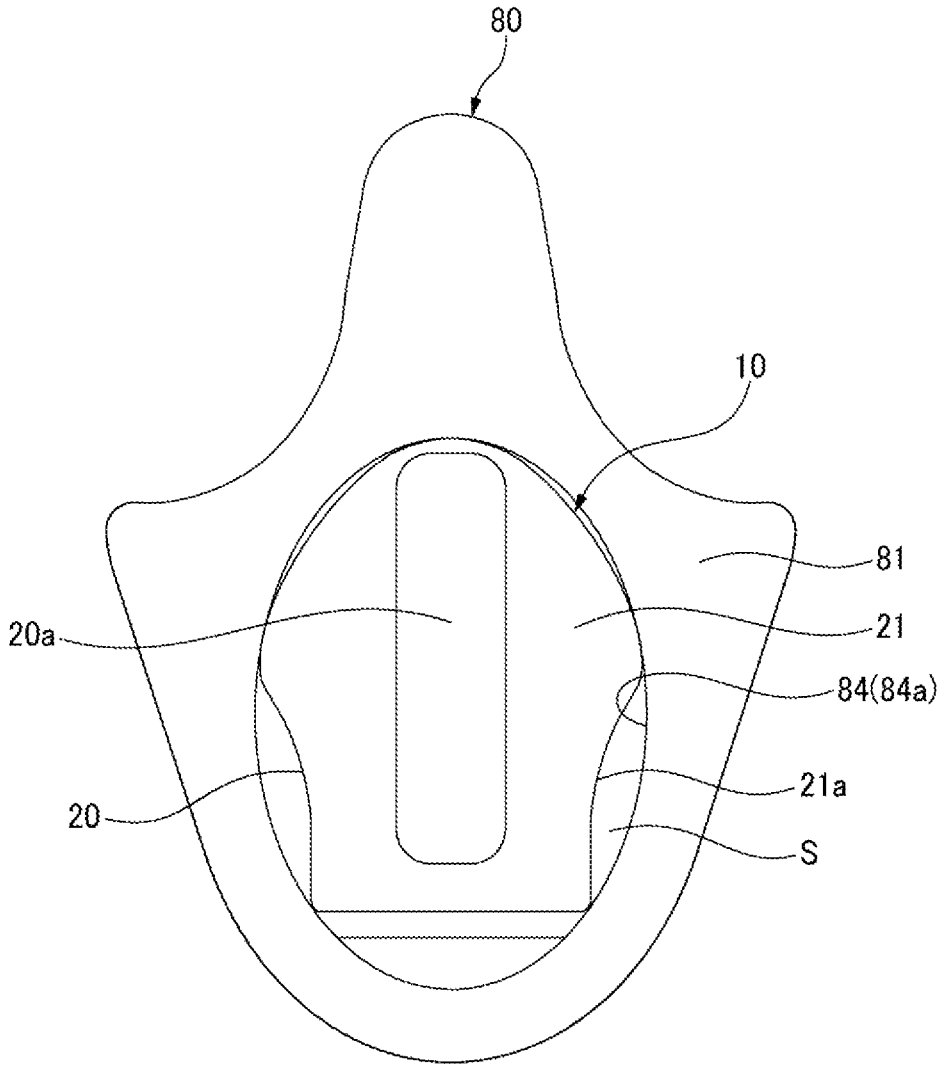
FIG. 23 is a top view explaining a state where a fourth embodiment of a slider cover according to the present invention is attached to a slider.

In addition, the receiving portion 84 is formed to be larger than the upper blade 21, and as shown in FIG. 23, a gap S is formed between the inner surface 84*a* of the receiving portion 84 and the side wall 21*a* of the upper blade 21 in a state where the slider cover 80 is attached to the slider 10. Also, the gap S is particularly formed to be larger in a width direction of the slider 10 so that the slider 10 can be easily received in the receiving portion 84 of the slider cover 80.

Figure 25:
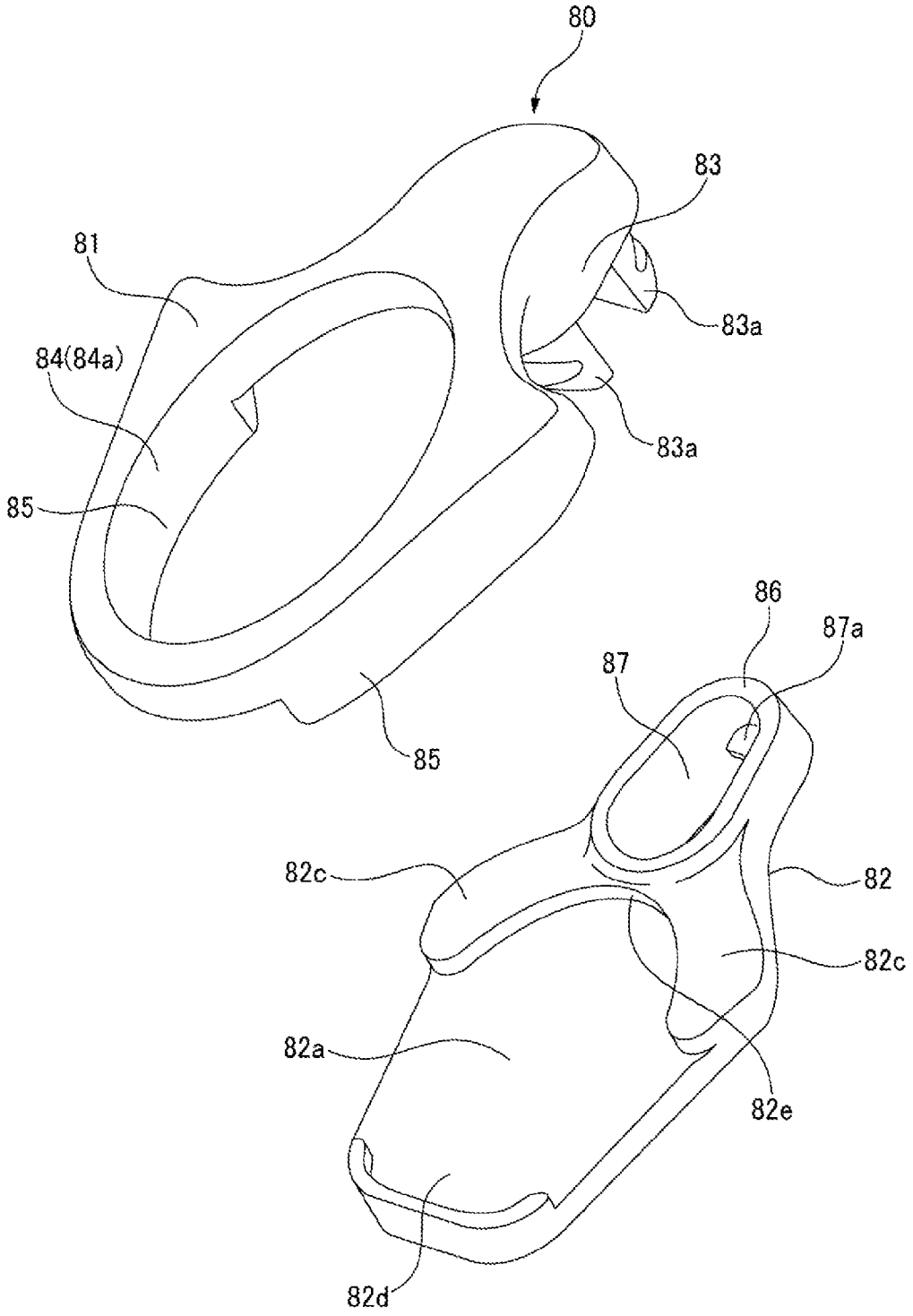
FIG. 25 is an exploded perspective view of the slider cover shown in FIG. 23.

Also, as shown in FIG. 25, the slider cover 80 includes cover-side flanges 85 formed along both right and left side edges of the upper plate 81 to protrude downward. More specifically, the cover-side flanges 85 are provided on both sides of the receiving portion 84 in a width direction thereof and extend from the lower surface of the upper plate 81 toward the lower plate 82. Also, inner surfaces of the cover-side flanges 85 are the same surface as the inner surface 84*a* of the receiving portion 84, and the cover-side flanges 85 are formed to extend from a front end to a rear end of the upper plate 81.

Figure 24:
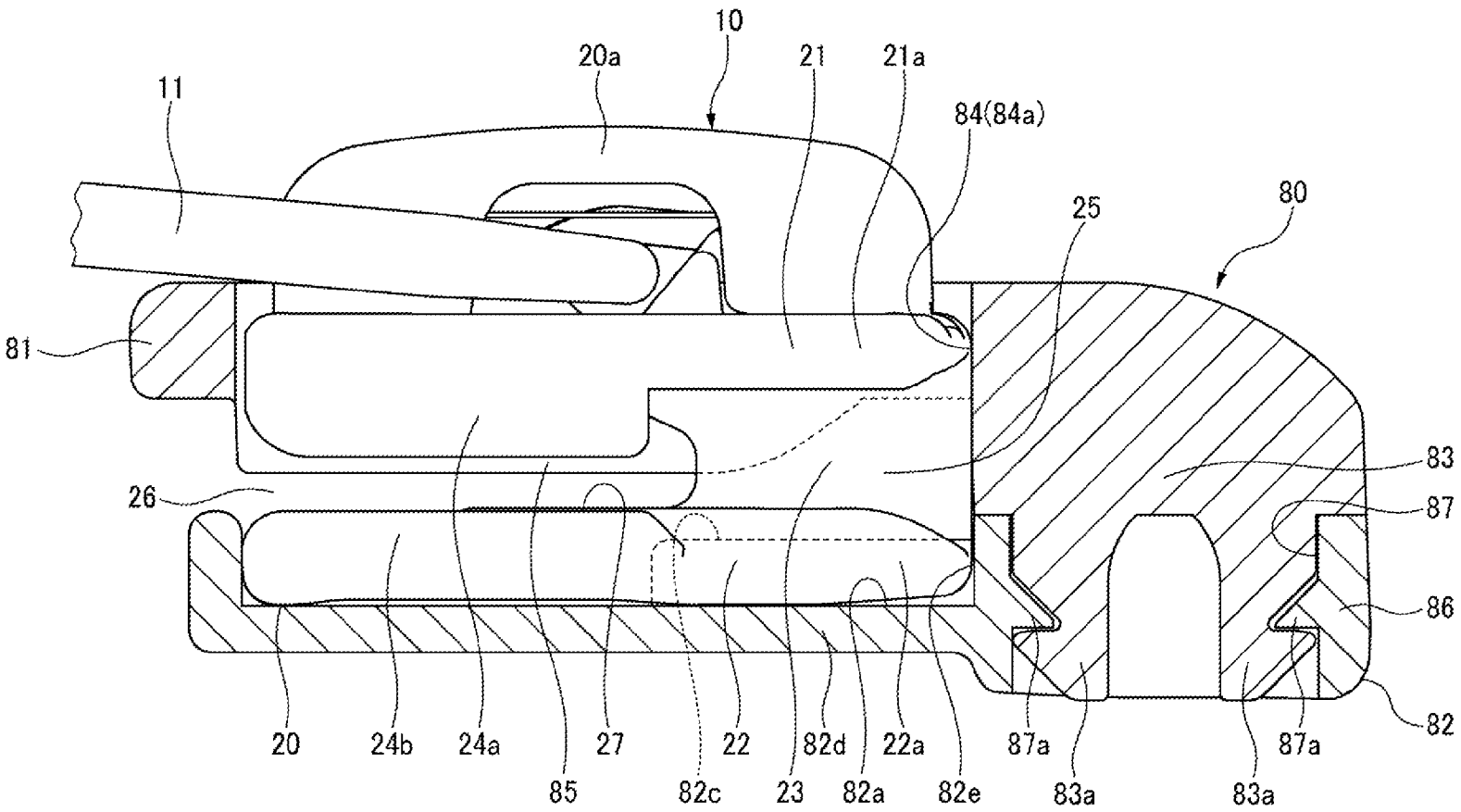
FIG. 24 is a longitudinal sectional view of the slider cover shown in FIG. 23.

Further, as shown in FIGS. 24 and 25, a recess portion 82*a* configured to receive the lower blade 22 of the slider 10 from a shoulder mouth 25-side end portion thereof to a rear mouth 26-side end portion thereof is formed on an upper surface of the lower plate 82. Thus, a lower surface of the lower blade 22 of the slider 10 is covered with the lower plate 82. In addition, a connection portion 86 having a connecting hole (engaging recess portion) 87 configured to connect with the connecting post 83 is formed on a front end of the lower plate 82.

Also, as shown in FIG. 25, the lower plate 82 is comprised of a pair of right and left first lower plates 82*c* extending from the connecting post 83 outward in the width direction and a second lower plate 82*d* extending from the pair of right and left first lower plates 82*c* and having an upper surface formed downward below upper surfaces of the pair of right and left first lower plates 82*c*, and a stepped portion 82*e*, which can come in contact with the side wall 22*a* of the lower blade 22, is formed between inner surfaces of the first lower plates 82*c* and an inner surface of the second lower plate 82*d*.

The connecting post 83 is of a generally elliptical cross-sectional shape, and as shown in FIGS. 24 and 25, a pair of front and rear engaging portions (engaging protrusion portions) 83*a* configured to be inserted into the connecting hole 87 of the connection portion 86 and thus to be respectively snapped and engaged to front and rear engaging protrusions 87*a* inside the connecting hole 87 is formed on a lower end of the connecting post 83.

Next, as for a method of attaching the slider cover 80 to the slider 10, the upper plate 81 and the lower plate 82 are arranged on top of one another with the slider 10 interposed therebetween and then the engaging portions 83*a* of the connecting post 83 of the upper plate 81 are snapped and engaged to the engaging protrusions 87*a* of the connecting hole 87 of the lower plate 82, thereby attaching the slider cover 80 to the slider 10.

In the slider cover 80 configured as described above, because the lower surface of the lower blade 22 of the slider 10 is covered with the lower plate 82 of the slider cover 80 made of synthetic resin, the lower blade 22 does not come in contact with a user, thereby preventing the lower blade 22 from giving a cool feeling to the user. Alternatively, so long as a function of preventing giving a cool feeling is imparted, it is not necessary to cover all of the lower blade 22 with the lower plate 82, and for example, as described in the first embodiment and the third embodiment, at least a part of the lower blade 22 may be covered. In addition, if at least a part of the lower blade 22 is covered, a possibility that the slider 10 comes directly in contact with a skin of the user is reduced.

As described above, according to the slider cover 80 of the present embodiment, the slider cover 80 includes the upper plate 81 and the lower plate 82, which are spaced apart from each other in the upward and downward direction and arranged in parallel to each other, and the connecting post 83 connecting the upper plate 81 with the lower plate 82, and the upper plate 81 has the receiving portion 84 configured to receive the upper blade 21 of the slider 10. Accordingly, the slider cover 80 can be simply attached to the slider 10 without performing a processing to the slider 10 and also the lower blade 22 can be prevented from giving a cool feeling to the user.

Alternatively, although in the present embodiment, the entire lower surface of the lower blade 22 is covered with the lower plate 82 of the slider cover 80, the present invention is not limited to that, and a protrusion portion protruding downward from the lower plate 82 may be provided to prevent the lower blade 22 from coming in contact with the user, and in this case, the entire lower surface of the lower blade 22 may not be covered with the lower plate 82.

The other configurations and the effects thereof are identical to those of the first embodiment.

In the foregoing, as the fourth embodiment, the slider cover 80 having a cool feeling prevention function in order to impart an additional function to the slider 10 has been described.

In the foregoing, even if the sliders used in the first to fourth embodiments are sliders to which special functions are not imparted, the slider cover, which is the prevent invention, can be used to provide a slide fastener having various functions. Therefore, there is no need to manage inventories of sliders for each function as in a conventional case, and thus a highly versatile slide fastener can be provided.

Meanwhile, the present invention is not limited to those that were illustrated in the foregoing embodiments but can be suitably changed without departing from the concept of the present invention.

DESCRIPTION OF REFERENCE NUMERALS

10 Slider for Slide Fastener
11 Pull Tab
20 Body
20*a* Pull Tab Attachment Portion
21 Upper Blade
21*a* Side Wall
22 Lower Blade
22*a* Side Wall
23 Guide Post
24*a* Upper Flange (Slider-Side Flange)
25 Shoulder Mouth
26 Rear Mouth
30 Slide Fastener
31 Fastener Element Row
32 Fastener Tape
50, 60, 70, 80 Slider Cover
51, 61, 71, 81 Upper Plate (Upper Member)
52, 62, 72, 82 Lower Plate (Lower Member)

52*a*, 62*a*, 72*a*, 82*a* Recess Portion
52*b* Recessed Groove
52*c*, 72*c*, 82*c* First Lower Plate
52*d*, 72*d*, 82*d* Second Lower Plate
52*e*, 72*e*, 82*e* Stepped Portion
53, 63, 73, 83 Connecting Post
54, 64, 74, 84 Receiving Portion
54*a*, 64*a*, 74*a*, 84*a* Inner Surface
S Gap
55, 65, 75, 85 Cover-Side Flange
56 Element Passage
56*a* Entrance Edge Portion
L1 Axis Line of Element Passage
θ Angle
63*b*, 73*a*, 83*a* Engaging Portion (Engaging Protrusion portion)
62*b*, 77, 87 Connecting Hole (Engaging Recess Portion)
72*f* Inclined Surface

The invention claimed is:

1. A slider cover for a slide fastener, comprising:

an upper member and a lower member which are spaced apart from each other in an upward and downward direction and arranged in parallel to each other; and a connecting post connecting the upper member with the lower member, wherein the upper member comprises a receiving portion configured to receive at least a part of an upper blade of a slider, wherein the receiving portion is a hole portion penetrating through upper and lower surfaces of the upper member, wherein the receiving portion has an inner surface for defining the hole portion, wherein at least a part of the inner surface receives the upper blade so as to come in contact with at least a part of a side wall of the upper blade, and wherein both sides of the receiving portion of the upper member in a width direction thereof are provided with cover-side flanges protruding downward.

2. The slider cover for the slide fastener according to claim 1, wherein the receiving portion is configured to receive an entire circumference of the upper blade.

3. The slider cover for the slide fastener according to claim 1, wherein the receiving portion is formed to be larger than the upper blade, and wherein in a state where the slider cover is attached to the slider, a gap is formed between the inner surface of the receiving portion and the side wall of the upper blade.

4. The slider cover for the slide fastener according to claim 1, wherein in a state where the slider cover is attached to the slider, an upper surface of the upper member and an upper surface of the upper blade are positioned at the same height.

5. The slider cover for the slide fastener according to claim 1, wherein the slider comprises a pull tab attachment portion provided on an upper surface of the upper blade and a pull tab attached to the pull tab attachment portion, and wherein the pull tab attachment portion and the pull tab are arranged above the upper member.

6. The slider cover for the slide fastener according to claim 1, wherein the cover-side flanges are formed along both right and left side edges of the upper member.

7. The slider cover for the slide fastener according to claim 6, wherein lower end edges of the cover-side flanges are arranged below lower end edges of slider-side flanges which are formed along both right and left side edges of the upper blade to protrude downward.

8. The slider cover for the slide fastener according to claim 1, wherein a recess portion configured to receive at least a part of a lower blade of the slider is formed on the lower member.

9. The slider cover for the slide fastener according to claim 8, wherein the lower member is comprised of a pair of right and left first lower plates extending from the connecting post outward in a width direction thereof and a second lower plate extending from the first lower plates and having an upper surface formed downward below upper surfaces of the first lower plates, and wherein a stepped portion which can come in contact with a side wall of the lower blade is formed between inner surfaces of the first lower plates and an inner surface of the second lower plate.

10. The slider cover for the slide fastener according to claim 9, wherein at least one of the pair of right and left first lower plates extends forward beyond the upper member.

11. The slider cover for the slide fastener according to claim 10, wherein inner surfaces of the first lower plates have an inclined surface inclined forward and downward from a rear end portion of the inner surface.

12. The slider cover for the slide fastener according to claim 1, further comprising a pair of right and left element passages formed between the upper member and the lower member and on both sides of the connecting post and configured to guide fastener element rows of the slide fastener.

13. The slider cover for the slide fastener according to claim 12, wherein at least one of the upper member and the lower member is formed with flanges respectively formed along both right and left side edges thereof and configured to guide the fastener element rows.

14. The slider cover for the slide fastener according to claim 12, wherein a pair of right and left recessed grooves are formed in a lower surface of the lower member along the pair of right and left element passages.

15. The slider cover for the slide fastener according to claim 12, wherein an angle of an entrance edge portion of the element passages with respect to an axis line of the element passages is set to be 90°±20°.

16. The slider cover for the slide fastener according to claim 1, wherein a recess portion configured to receive the lower blade of the slider from a shoulder mouth side end portion thereof to a rear mouth side end portion thereof is formed on the lower member.

17. The slider cover for the slide fastener according to claim 1, wherein the slider cover is formed by engaging a first member which is comprised of at least the upper member with a second member which is comprised of at least the lower member, and wherein the slider cover is connectable by an engaging protrusion portion which is formed on at least one of the first member and the second member and an engaging recess portion which is formed on at least the other of the first member and the second member.

18. A slide fastener with a slider cover, comprising a pair of fastener tapes, a pair of fastener element rows respectively attached to opposing tape side edge portions of the pair of fastener tapes, a slider inserted onto the pair of fastener element rows, and the slider cover configured to be detachably attached to the slider in a state where the slider is inserted onto the pair of fastener element rows, wherein the slider comprises: a body comprising an upper blade and a lower blade which are spaced apart from each other in an upward and downward direction and arranged in parallel to each other, a guide post connecting the upper blade with the lower blade at front end portions thereof, and a pull tab attachment portion provided on the upper blade; and a pull tab attached to the pull tab attachment portion, and wherein the slider cover is the slider cover according to claim 1.

* * * * *